US007685759B2

(12) United States Patent
Teetzel

(10) Patent No.: US 7,685,759 B2
(45) Date of Patent: Mar. 30, 2010

(54) THREE-POINT CLAMP FOR FIREARM MOUNTING RAIL

(75) Inventor: James W. Teetzel, York, ME (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 11/933,887

(22) Filed: Nov. 1, 2007

(65) Prior Publication Data

US 2008/0216380 A1 Sep. 11, 2008

Related U.S. Application Data

(60) Provisional application No. 60/855,928, filed on Nov. 1, 2006, provisional application No. 60/879,823, filed on Jan. 10, 2007, provisional application No. 60/920,107, filed on Mar. 26, 2007.

(51) Int. Cl.
*F41G 1/387* (2006.01)

(52) U.S. Cl. ..... 42/127

(58) Field of Classification Search ..... 42/124, 42/125, 126, 127, 128

See application file for complete search history.

(56) References Cited

U.S. PATENT DOCUMENTS 6,442,883 B1 * 9/2002 Waterman et al. ..... 42/124
6,922,934 B1 * 8/2005 Huan ..... 42/127

* cited by examiner

*Primary Examiner*—Stephen M Johnson
(74) *Attorney, Agent, or Firm*—McLane, Graf, Raulerson & Middleton, P.A.; Scott C. Rand

(57) ABSTRACT

An improved clamping device for a weapon accessory rail of a type having an elongate mounting structure of generally T-shaped cross-section. The rail mounting structure may be of a type including a mounting surface and first and second inclined proximal surfaces on opposite sides of the mounting surface and first and second inclined distal surfaces adjacent the first and second proximal surfaces, respectively. The clamping device includes a mounting shoe with a first inward surface for engaging the mounting surface and a second inward surface for engaging the second distal surface. The mounting shoe has an outward facing surface opposite the first inward facing surface for attaching an accessory device. A cam lever pivotally movable between first and second positions has a rotary cam surface engaging a bearing member. The bearing member is movable between a clamped position and unclamped position in response to movement of the cam lever to the first and second positions, respectively. In operation, the bearing member exerts a clamping force on the first distal surface of the mounting structure in a direction orthogonal to the first distal surface.

16 Claims, 23 Drawing Sheets

THREE-POINT CLAMP FOR FIREARM MOUNTING RAIL

RELATED APPLICATIONS

This application is related to U.S. provisional patent application Nos. 60/855,928 filed Nov. 1, 2006; 60/879,823 filed Jan. 10, 2007; and 60/920,107 filed Mar. 26, 2007. Each of the aforementioned applications is herein incorporated by reference in its entirety.

BACKGROUND

The present disclosure relates to clamp device for attachment to a so-called Picatinny or floating rail structure (e.g., as per standard MIL-STD-1913) of a type commonly attached to a military firearms for attaching optical scopes, thermal or laser sights, tactical flashlights, vertically extending handgrips, or other weapon-mounted accessories. Referring now to FIG. 1, there appears a conventional elongate Picatinny rail mount structure 10 having a plurality of mounting members 12, each having a generally T-shaped cross-section, angularly spaced about the long axis of the structure 10 and extending radially outward. Each of the mounting members 12 includes a flat mounting surface 14. The opposite transverse edges of the mounting members 12 are beveled to form proximal inclined surfaces 16*a* and 16*b*, which are generally outwardly facing, and distal inclined surfaces 18*a* and 18*b*, which are angled with respect to the respective surfaces 16*a*, 16*b*. A plurality of transversely-extending channels or grooves 20 are formed in each mounting member 12 and spaced along its length.

Conventional Picatinny rail clamp devices as illustrated by the exemplary device shown in FIGS. 2 and 3 commonly employ opposing clamping members 22 and 24 having inclined surfaces 26 and 28 aligned with and facing the distal inclined surfaces 18*a* and 18*b* of the mounting rail structure 10 and which are drawn together to bear against the inclined surfaces 18*a*, 18*b* via a transverse clamping force, such as a nut 30 rotatably engaging a transversely extending threaded member 32. Such prior art devices relying on a transverse clamping force do not maintain the original orientation when removed and reattached to the mounting rail. Consequently, aiming or targeting devices that are attached with conventional clamps may need to re-boresighted with the barrel of the weapon if removed and reattached to the weapon.

Thus, it would be desirable to provide a clamp device for securing an accessory to a firearm via a Picatinny rail interface which would maintain its original orientation when removed and reattached, thereby allowing an optical, sighting or other aiming or targeting device to maintain its boresight when removed and subsequently reattached to the Picatinny Rail. The present device contemplates improved clamp devices which overcome the above-referenced limitations and others.

SUMMARY

An improved clamping device is provided for a weapon accessory rail of a type having an elongate mounting structure of generally T-shaped cross-section shape. The rail mounting structure may be of a type including a mounting surface and first and second proximal surfaces on opposite sides of the mounting surface and inclined with respect to the mounting surface. A first distal surface of the rail mounting structure is adjacent to and inclined with respect to the first proximal surface and a second distal surface is adjacent to and inclined with respect to the second proximal surface. The clamping device includes a mounting shoe defining a channel and including a first inward facing surface for engaging the mounting surface of the mounting structure. The mounting shoe has an outward facing surface opposite the first inward facing surface for removably attaching an accessory device and further includes a second inward facing surface for engaging the second distal surface of the mounting structure. A cam lever is pivotally movable between a first position and a second position and has a rotary cam surface engaging a bearing member. The bearing member is movable to a clamped position in response to movement of the cam lever to the first position and an unclamped position in response to movement of the cam lever to the second position. In operation, the bearing member exerts a clamping force on the first distal surface of the mounting structure which is in a direction orthogonal to the first distal surface.

One advantage of the clamping devices in accordance with the present disclosure is found in that the clamping force is exerted in a direction orthogonal to the distal inclined clamping surface of the rail interface thereby providing secure retention of an accessory device.

Another advantage of the presently disclosed clamping device resides in the ability to maintain a precise alignment upon removal and reattachment of the device. In this manner, precisely aligned or boresighted accessory devices such as scopes, sights, or other sighting, aiming or targeting devices may be temporarily removed and reattached without the need for realigning the device.

Still further advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
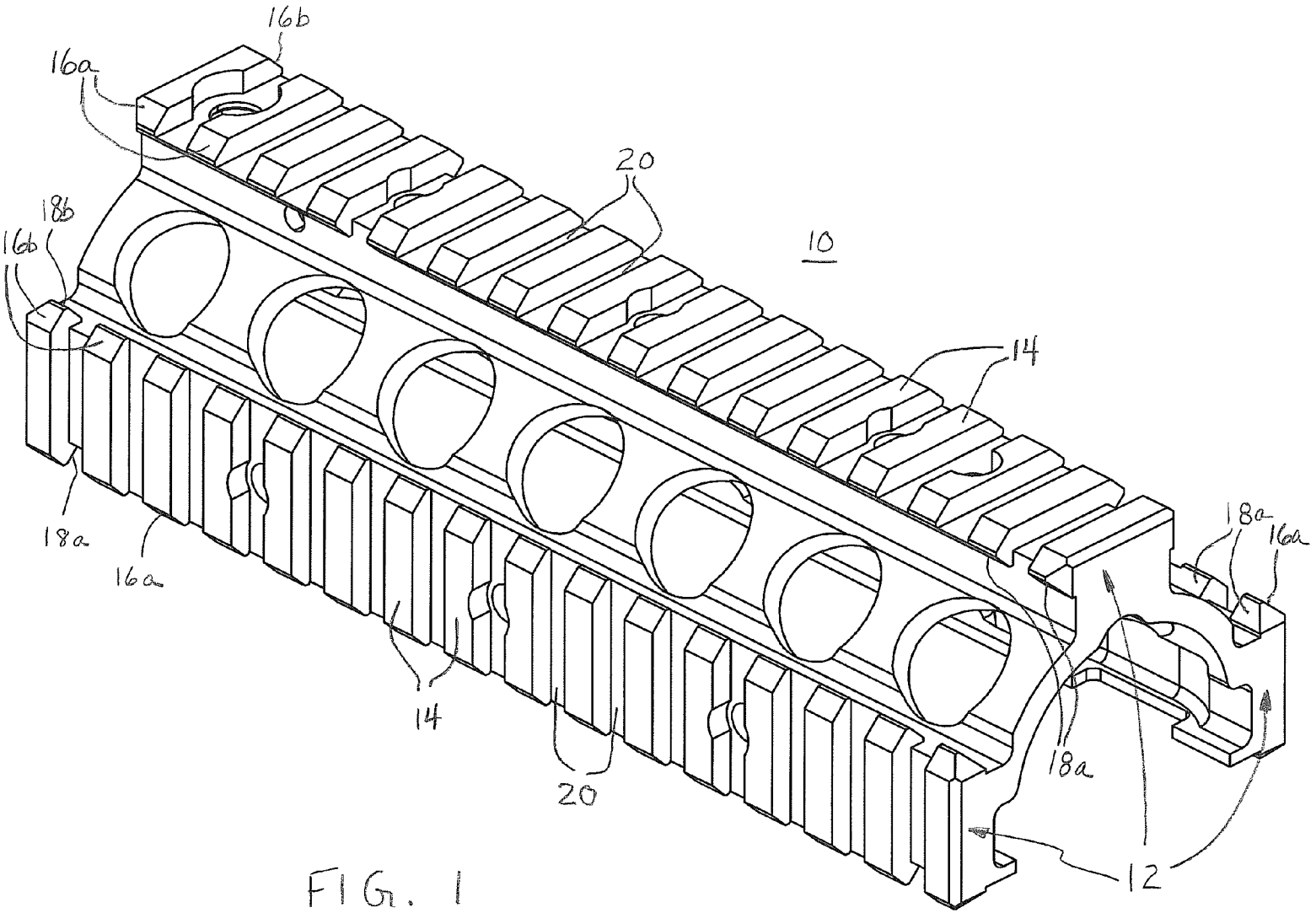
FIG. 1 (PRIOR ART)
FIG. 1 illustrates a conventional Picatinny rail mounting structure.
Figure 2:
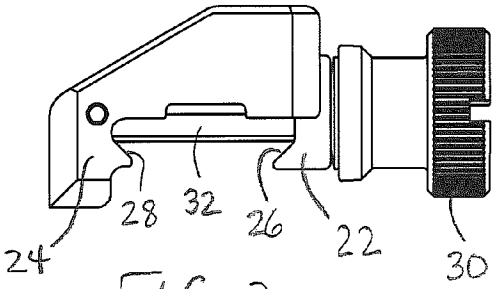
FIG. 2 (PRIOR ART)
FIGS. 2 and 3 illustrate a prior art clamping device.
Figure 3:
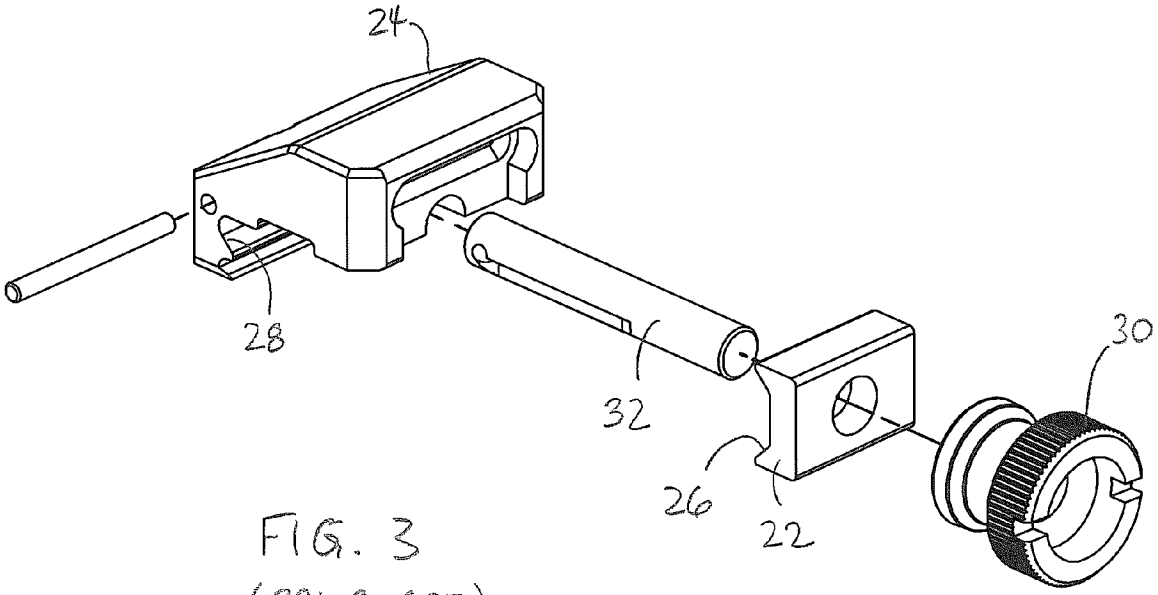
FIG. 3 (PRIOR ART)
Figure 4:
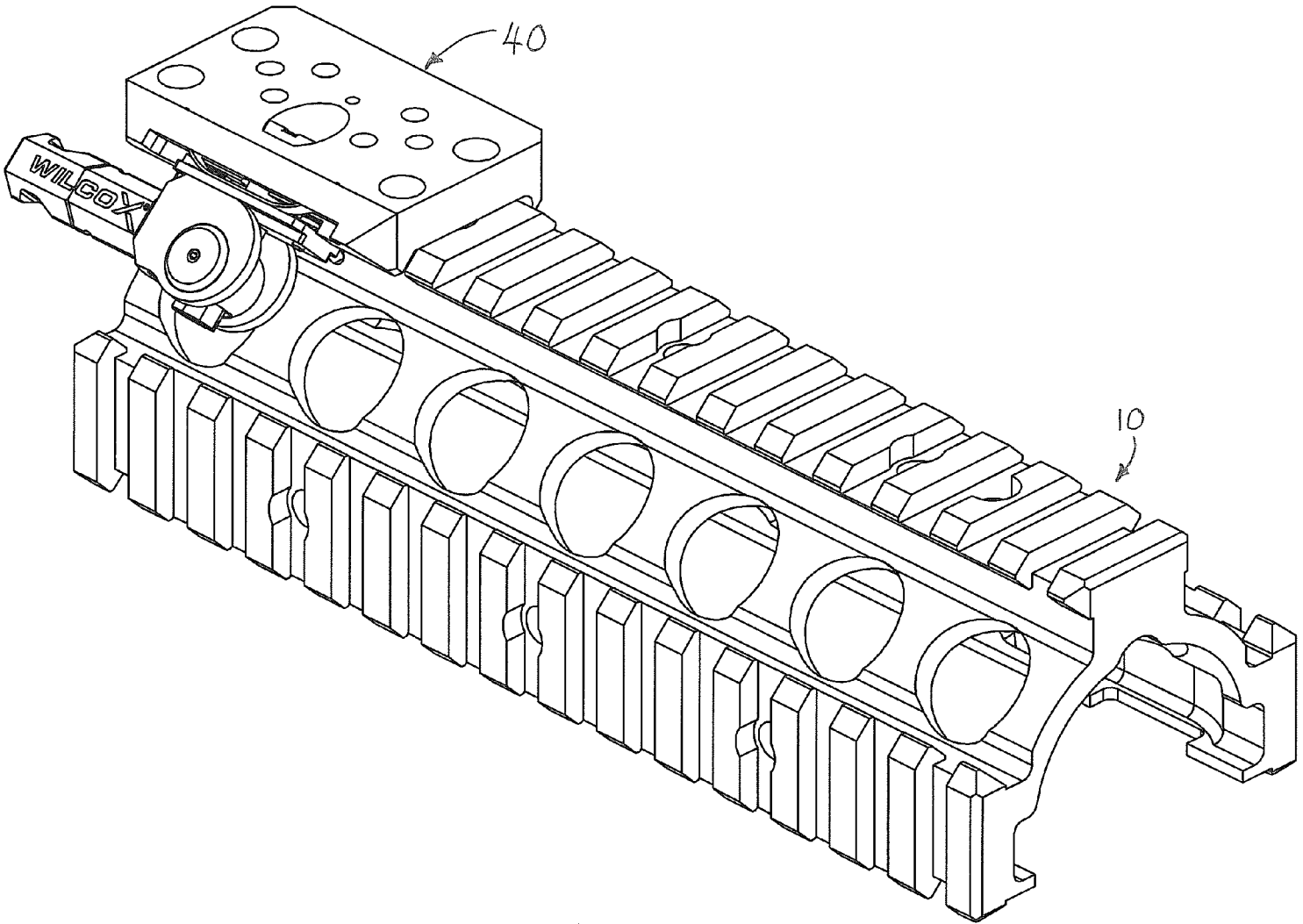
FIGS. 4 and 5 are generally front and rear pictorial views, respectively, of a first exemplary embodiment clamping apparatus herein shown in secured position on a Picatinny rail mounting structure.
Figure 5:
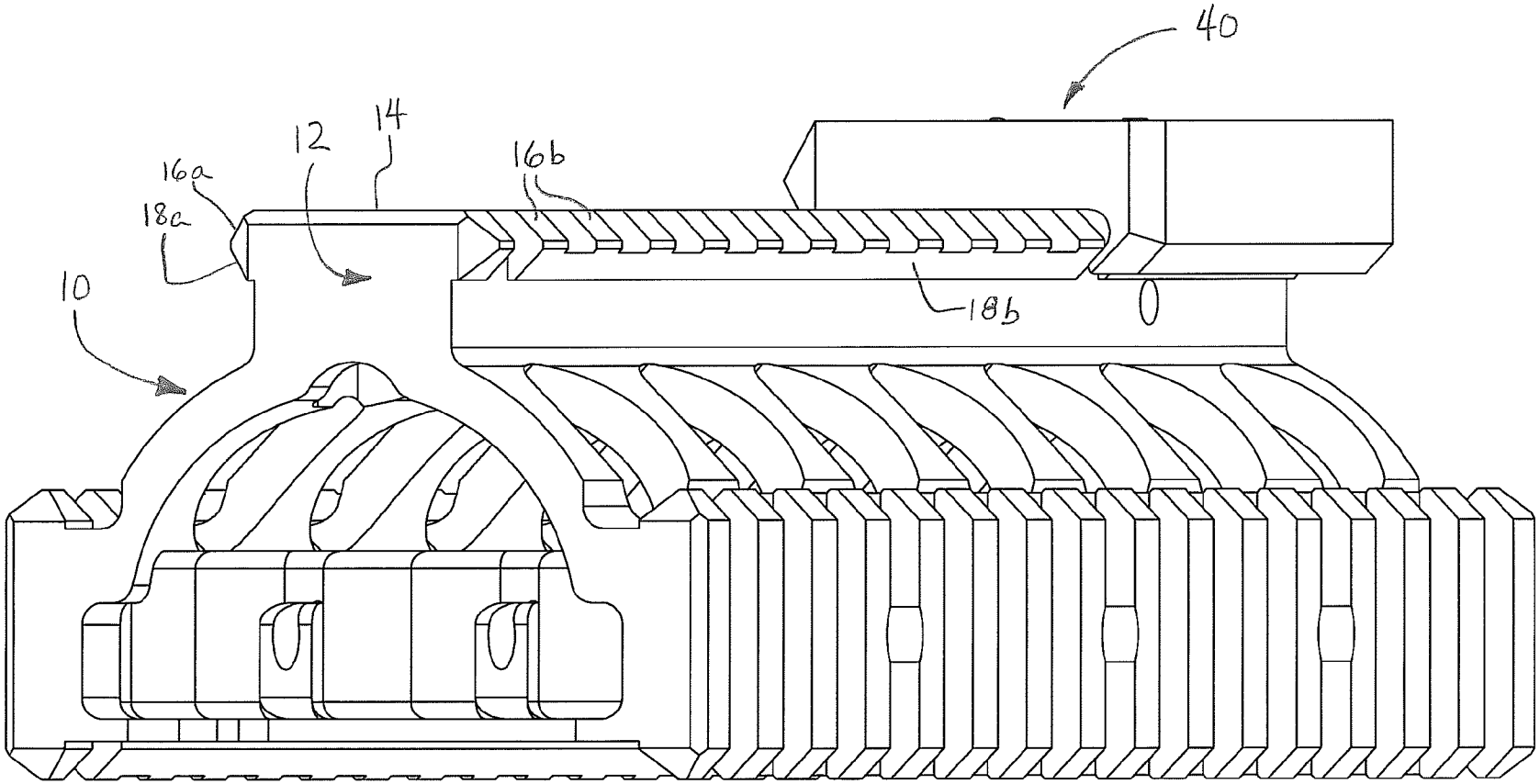
Figure 6:
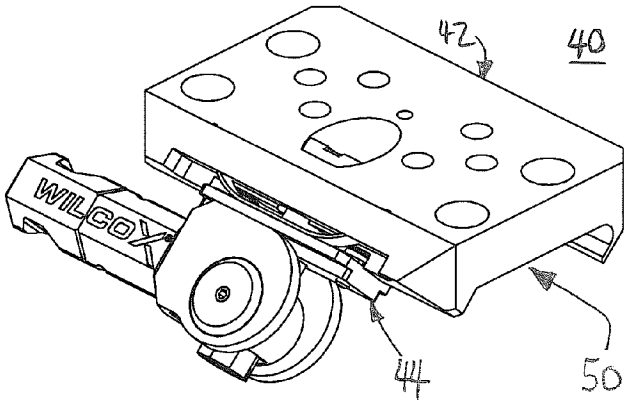
FIGS. 6 and 7 are isometric views of the clamp device embodiment appearing in FIGS. 4 and 5, in locked and unlocked position, respectively.
Figure 9:
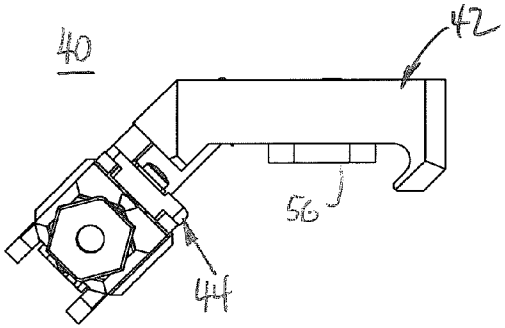
FIGS. 8 and 9 are elevational views of the clamp embodiment appearing in FIGS. 4-7, in locked and unlocked position, respectively.
Figure 7:
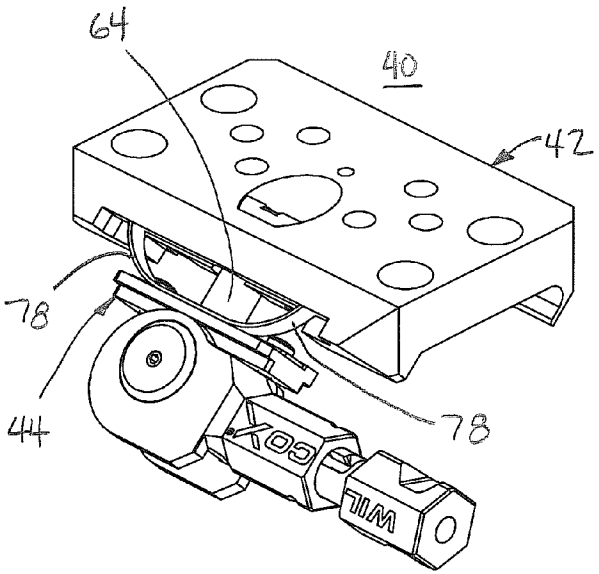
Figure 10:
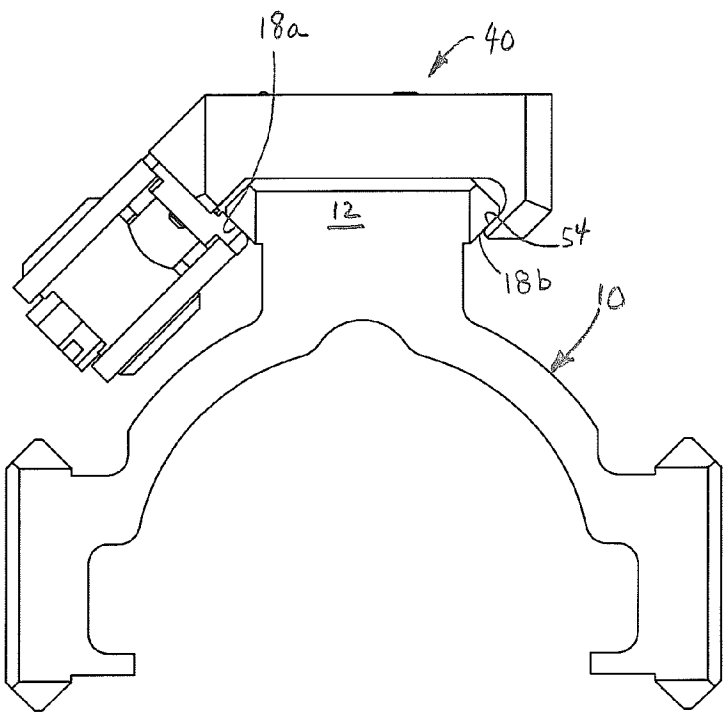
FIG. 10 is an elevational view of the clamp embodiment appearing in FIGS. 4-9 in clamped position on a Picatinny rail interface.
Figure 8:
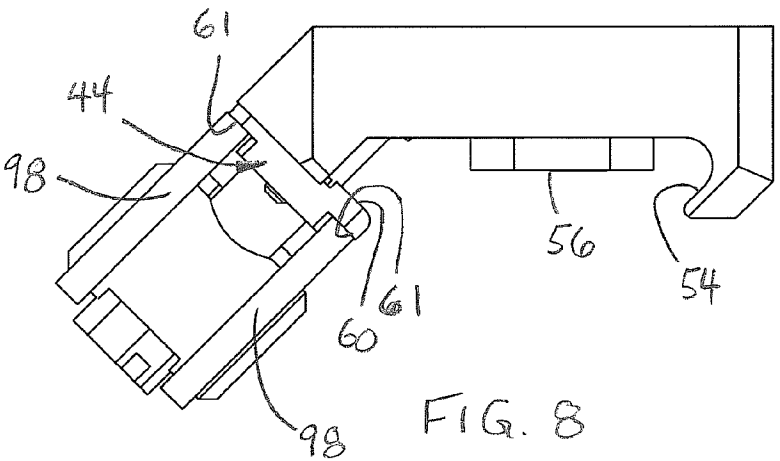
Figure 11:
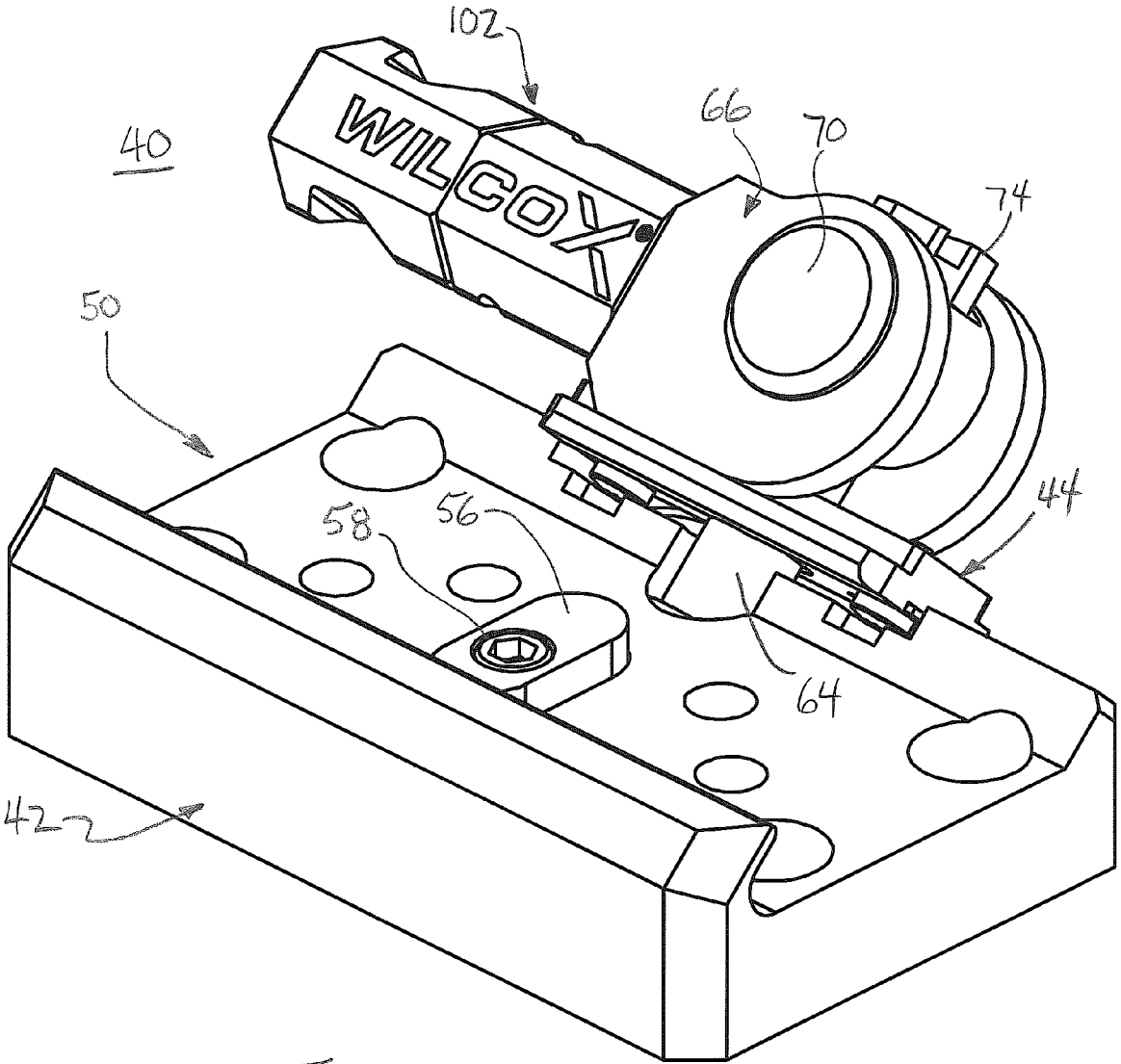
FIG. 11 is an enlarged isometric view of the clamp embodiment appearing in FIGS. 4-10 embodiment in locked position, taken generally from the bottom.
Figure 12:
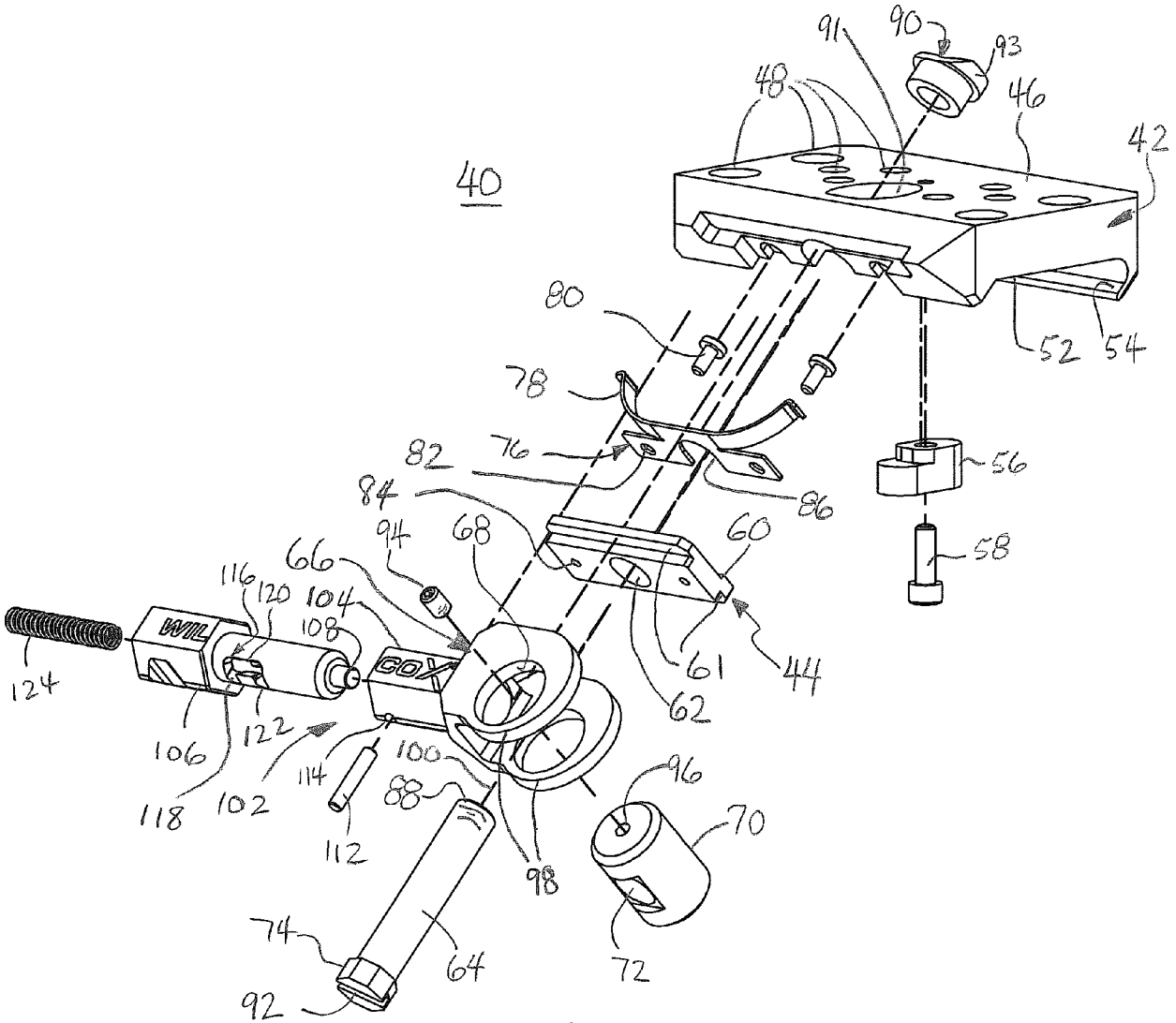
FIG. 12 is an exploded isometric view of the clamp embodiment appearing in FIGS. 4-11.
Figure 13:
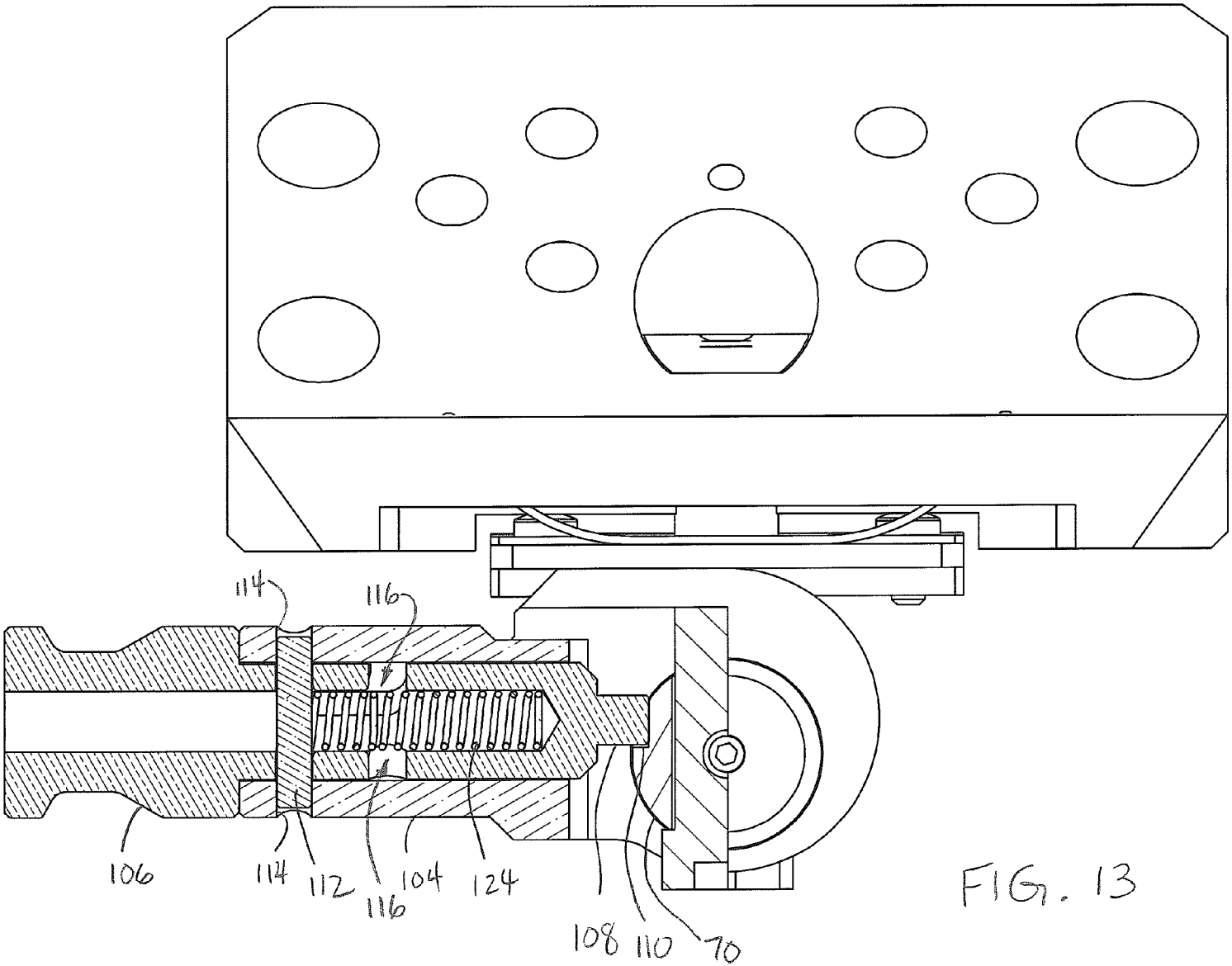
FIG. 13 is an enlarged view of the embodiment appearing in FIGS. 4-12, wherein the locking cam lever is shown in partial cross-section.

Referring now to FIGS. 4-13, a first exemplary embodiment three-point clamp in accordance with the present disclosure includes a mounting shoe 42 and a movable clamping member 44. The mounting shoe 42 includes an upper (in the orientation shown in FIG. 4) surface 46 having apertures 48, which are preferably tapped or internally threaded openings for securing an accessory or device (not shown) to the surface 46 for removable mounting on the weapon rail interface using the clamping member 40.

The mounting shoe 42 defines an axial channel 50 defined by a first inner surface 52 opposite the upper surface 46 for engaging the mounting surface 14 in aligned and facing contacting relation when the unit 40 is attached to a weapon rail 10 mounting member 12. The axial channel 50 is also defined by a second inner surface 54 for engaging distal inclined surface 18*b* in aligned and facing contacting relation when the unit 40 is attached to a weapon rail 10 mounting member 12.

In the depicted embodiment 40, a protruding member 56 may be secured to the inner surface 52 via a threaded fastener 58. The protruding member 56 is adapted to be received within a selected one of the grooves 20 to prevent axial movement of the clamping member 40, e.g., due to recoil of the firearm when a round is fired.

In the depicted embodiment, the movable member 44 comprises a bearing plate, which is movable between a first, unclamped position and a second, clamped position. The bearing plate 44 includes a first, rail engaging surface 60, which engages the distal inclined surface 18*a* in aligned and facing contacting relation when the unit 40 is attached to a weapon rail 10 mounting member 12. The bearing plate 44 also includes cam engaging surfaces 61, which are opposite the rail engaging surface 60.

The bearing plate 44 includes an opening 62 receiving a drawbar 64 such that the bearing plate 44 is slidable therealong. The bearing plate 44 is captured between a rotatable cam member 66 and the mounting shoe 42. The cam member 66 is rotatable between a locked position and an unlocked position, via a lever 102, a preferred embodiment of which is described in greater detail below. The bearing plate 44 is thus selectively moved between the clamped position and unclamped position when the cam 66 is moved between the locked and unlocked position, respectively.

The cam member 66 includes an offset opening 68 receiving a pivot pin or cylinder 70 about which the cam member 66 pivots or rotates. The drawbar 64 passes through an opening 72 in the pivot pin 70 and is retained by an enlarged head portion 74 of the drawbar 64. A spring member 76 includes spring arms 78 and is secured to the bearing plate 44 via threaded fasteners 80 engaging aligned openings 82 and 84 in the spring member 76 and bearing plate 84, respectively.

The drawbar 64 additionally passes through an opening 86 in the spring member 76 and includes a threaded end 88 which rotatably engages an internally threaded nut 90 received within an opening 91 in the mounting shoe 42. The nut 90 may include a flange portion 93 to retain the nut in the opening 91. Rotation of the drawbar 64, e.g., via a slot 92 for receiving a tool formed in the head 74, allows for adjustment of the unit by selectively advancing or retracting the drawbar 64 to fine tune the effective length of the draw bar 64 and thereby precisely position the plate 44 when in the lever 102 is moved into the clamped position. In this manner, the device 40 may be adjusted to accommodate minor variations from one rail interface structure 10 to another.

A threaded set screw 94 may be rotatably received within a threaded opening 96 in the pivot cylinder 70. The set screw 94 may be rotated until it bears against the drawbar 64 so as to retain the drawbar 64 at a desired rotational position and prevent further rotation of the drawbar 64 relative to the nut 90, e.g., due to vibrational forces when the weapon is fired.

The spring arms 78 urge the bearing plate 44 against peripheral cam surfaces 98 on the cam member 66, whereby the bearing plate is selectively moved toward or away from the distal inclined surface 18*a* in response to unlocking rotation of the cam member 66. The bearing surface 60 lies in a plane which is orthogonal to the axis 100 of the drawbar 64 and thus, the surface 60 is parallel to the facing distal inclined surface 18*a*. Thus, the bearing plate 44 travels in a direction which is orthogonal to the adjacent inclined surface 18*a* and exerts a force which is normal to or orthogonal to the plane of the distal inclined surface 18*a* when the cam 66 is rotated to the locked or clamped position. In this manner, the device 40 provides a secure clamping force which is orthogonal to each of the two opposing distal inclined rail surfaces 18*a*, 18*b* and the upper mounting surface 14 of the mounting structure 12.

A cam lever 102 is provided for rotating the cam member 66. In the depicted preferred embodiment, the cam lever 102 is a locking cam lever and includes a hollow, proximal shaft portion 104 and a hollow distal shaft portion 106. The distal shaft portion 106 is slidably received within the hollow proximal shaft portion 104 and includes an end 108 which engages a notch 110 formed on the pivot cylinder 70 when the lever is moved to the clamped position and the distal shaft portion 106 is completely received within the proximal shaft portion 104. When the end 108 of the distal shaft portion 106 engages the notch 110, the shaft 102 is locked, e.g., preventing inadvertent movement of the lever 102 and thereby preventing inadvertent unclamping of the unit 40.

To retain the distal shaft portion 106 in telescoping engagement with the proximal shaft portion 104, a fixed retaining pin 112 passes through openings 114 in the proximal shaft portion and runs in generally U-shaped openings 116 in the distal shaft portion 106.

In operation, the pin 112 engages the outer leg 118 of the U-shaped openings 116 when the lever 102 is in the locked position. To unlock the lever 102, the distal shaft portion 106 is rotated until the pin 112 is received within the axial-extending portion 120 of the U-shaped channels 116. A spring 124, which is captured within the hollow interior portion of the distal shaft portion 106 by the retaining pin 112 bears against the pin 112 and urges or biases the distal shaft portion 106 toward the unlocked position. When the lever 102 is unlocked, the end 108 disengages the notch 110 and the cam member 66 may be rotated to the unlocked position. To lock the lever 102, the lever 102 is rotated to the locked position and the distal shaft portion 106 is moved inwardly to compress the spring 124 until the end 108 engages the notch 110. The distal shaft portion 106 is then rotated until the pin 112 is received within the outer leg portion 118 of the U-shaped channels 116.

Figure 14:
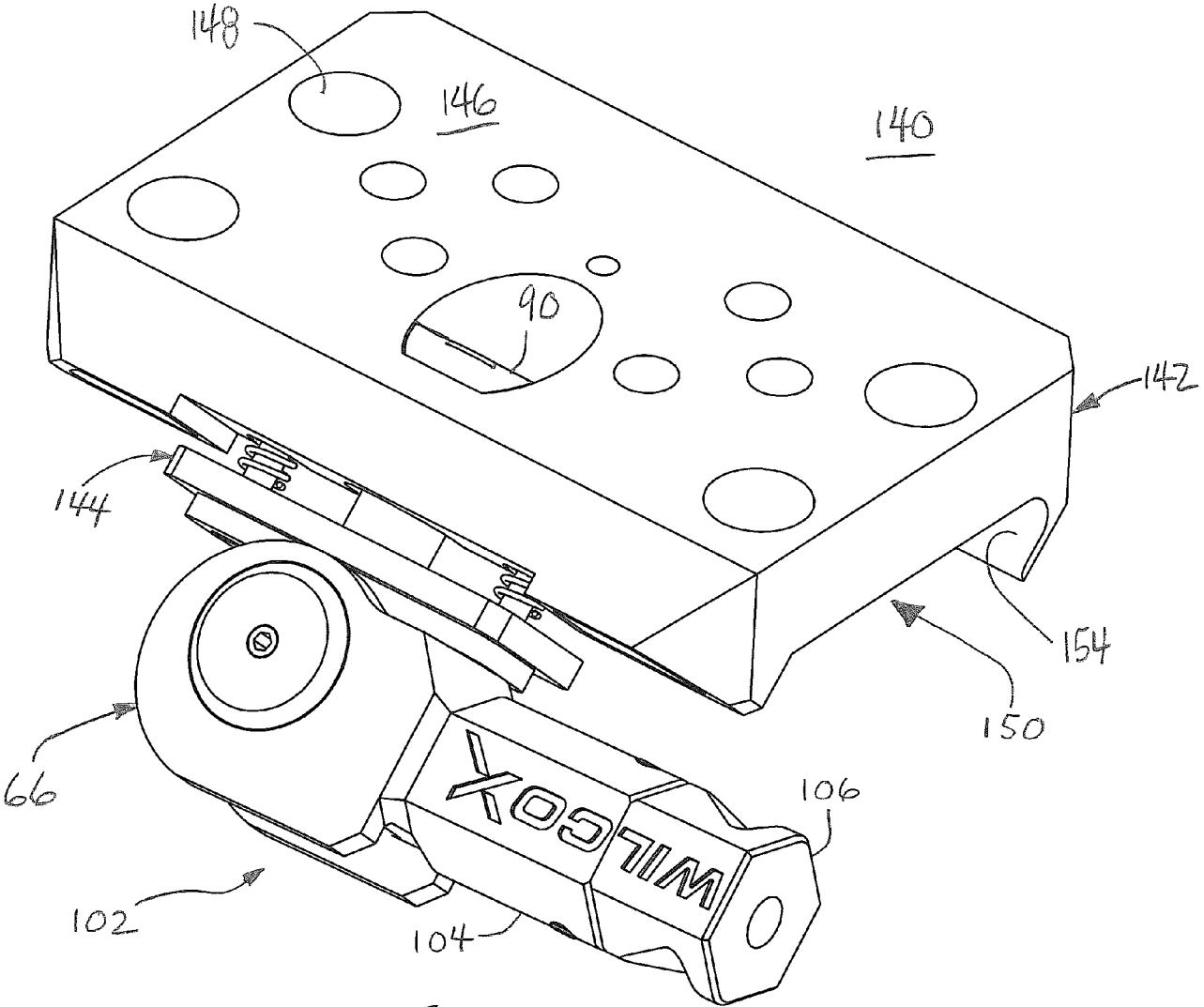
FIG. 14 is an isometric view of a second exemplary embodiment clamping device, shown in the unlocked position.
Figure 15:
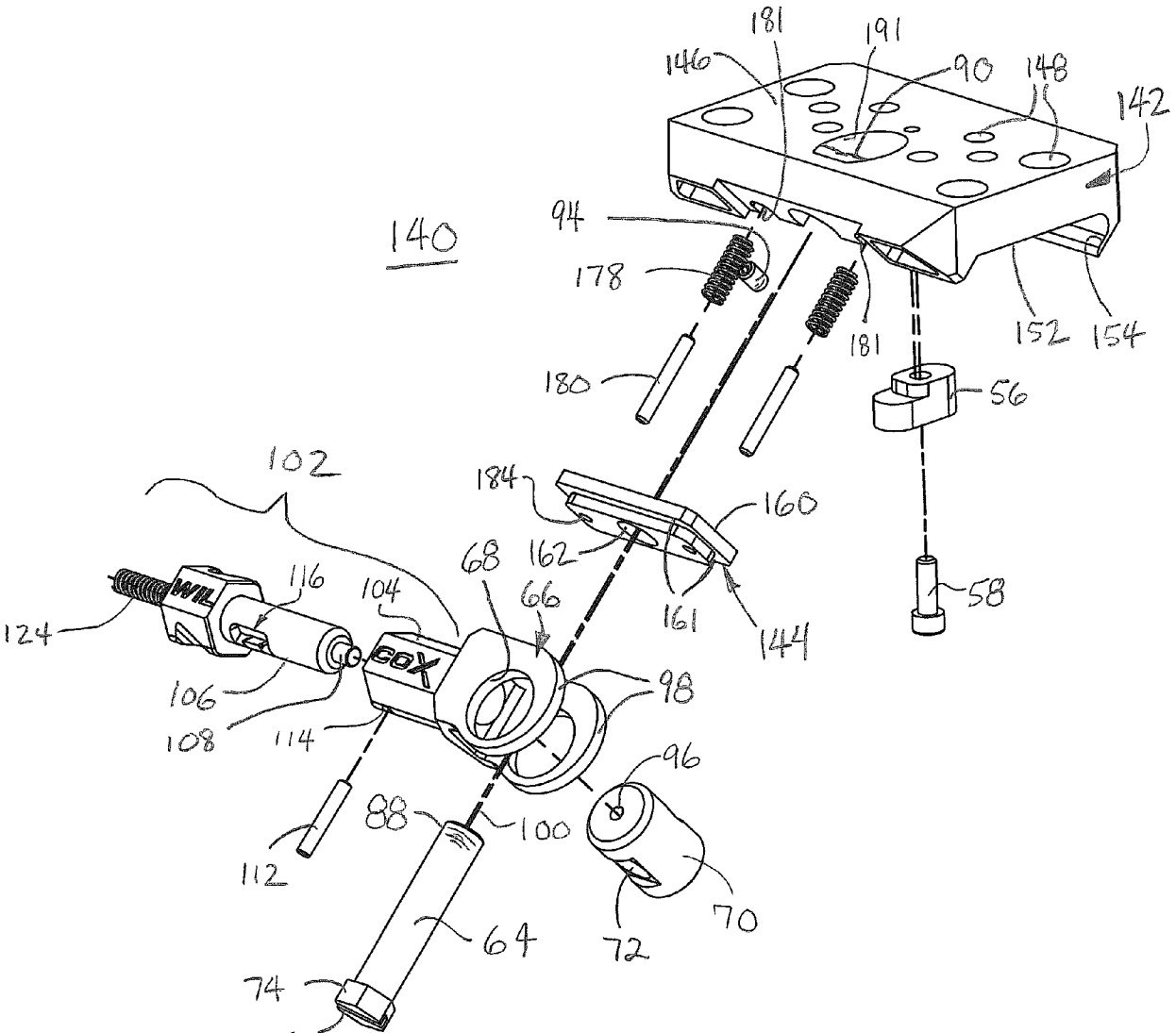
FIG. 15 is an exploded isometric view of the second embodiment clamping device shown in FIG. 14.
Figure 16:
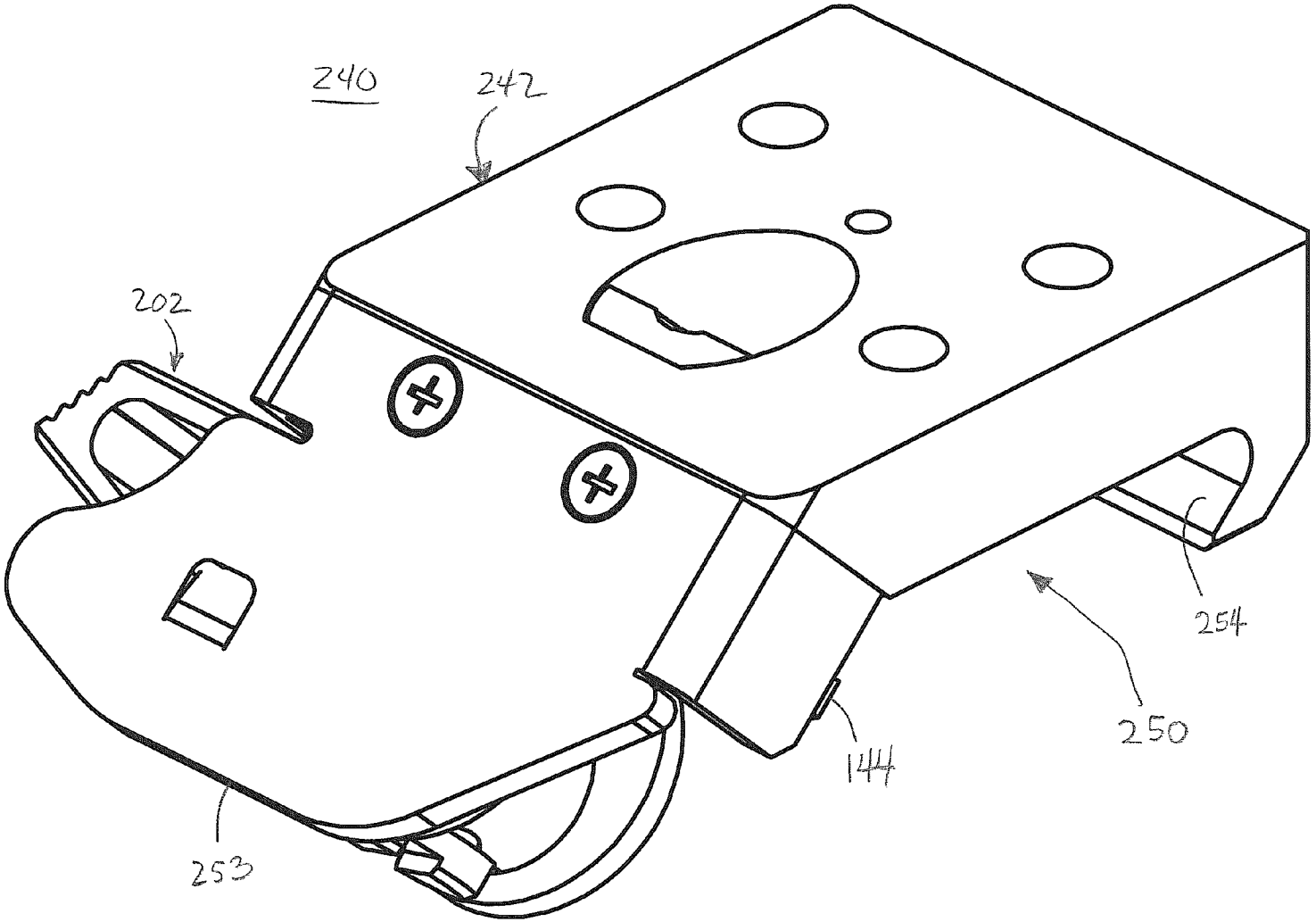
FIGS. 16 and 17 are isometric views of a third exemplary embodiment clamping device, shown in the locked and unlocked position, respectively.
Figure 17:
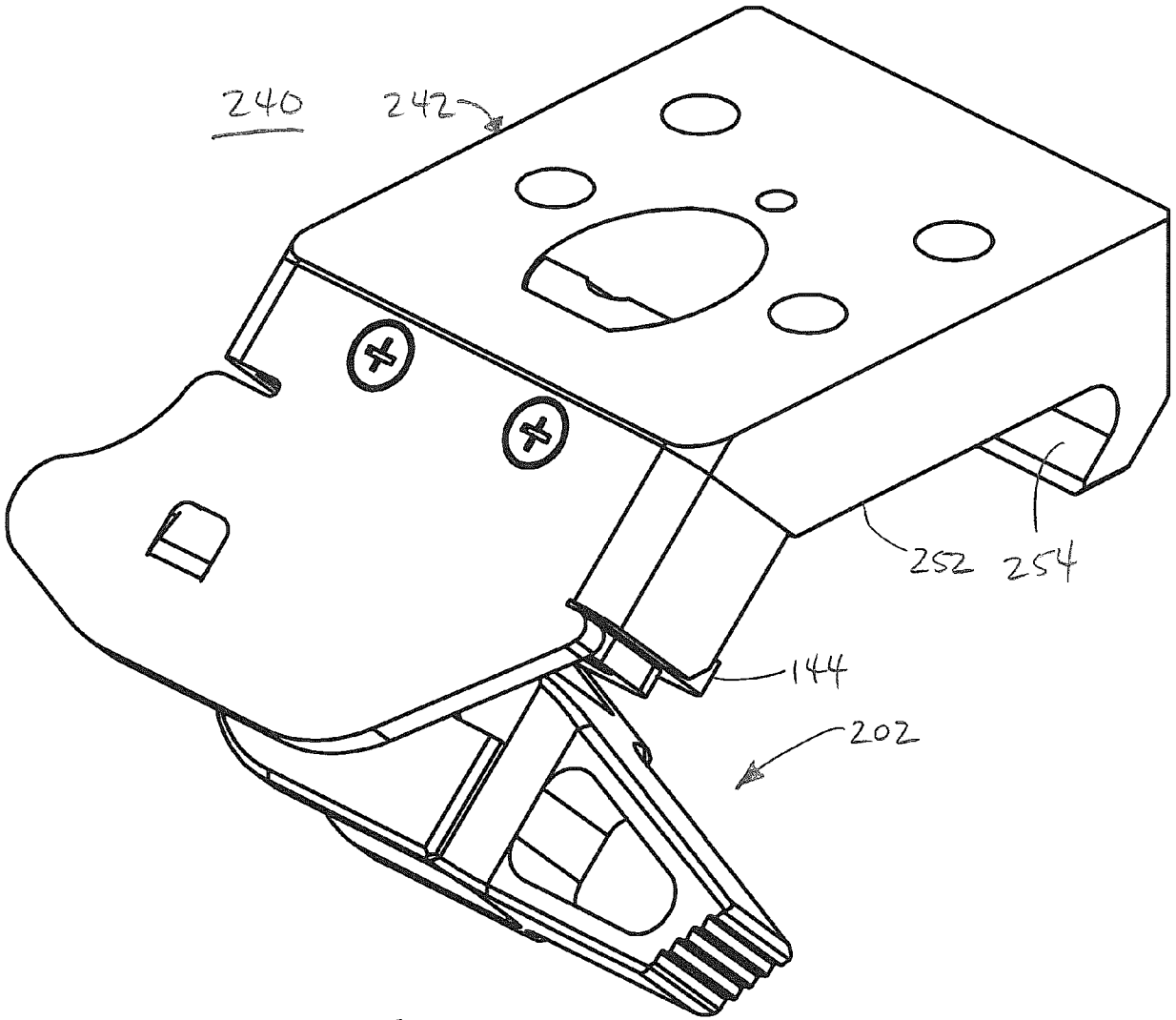
Figure 18:
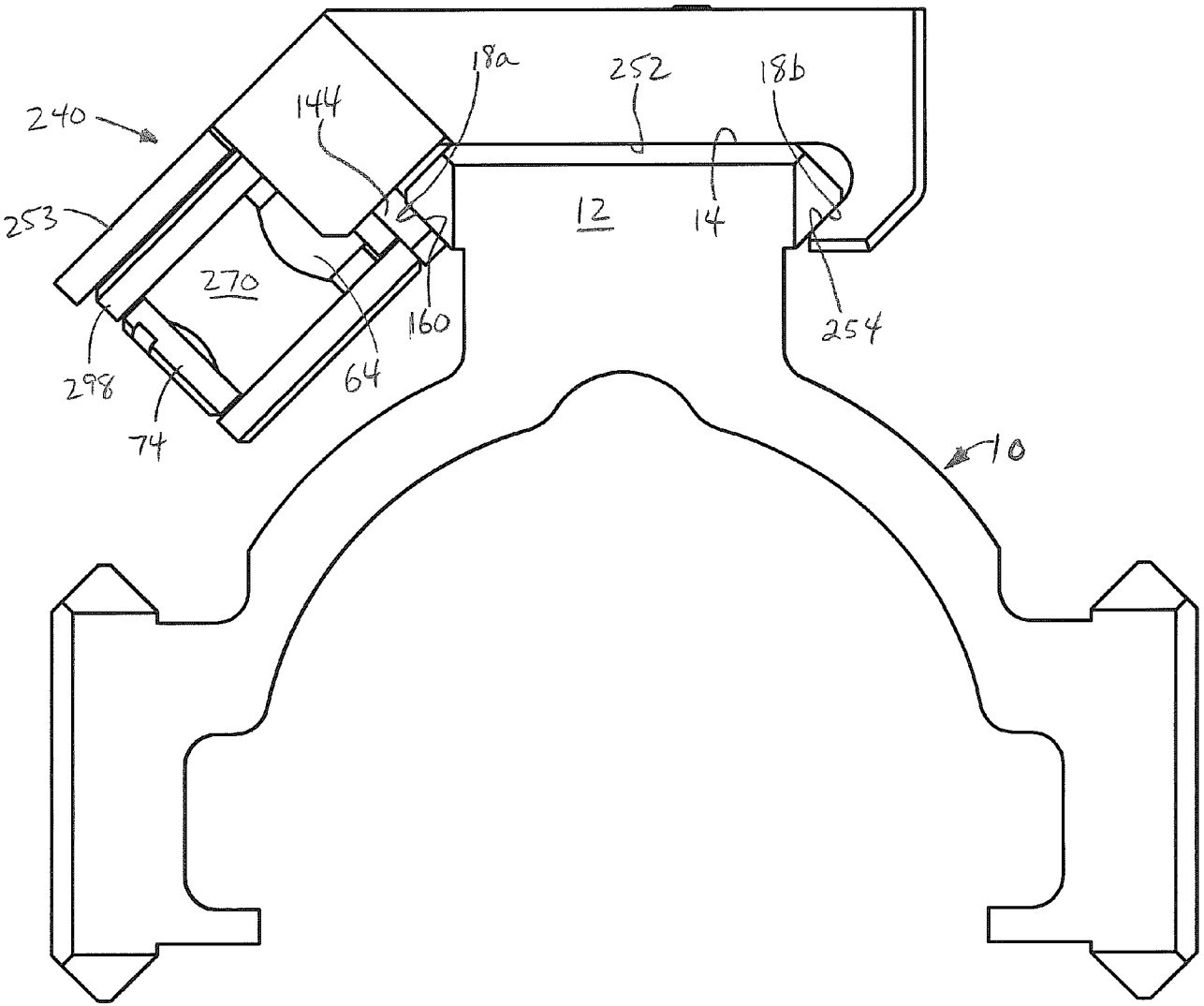
FIGS. 18 and 19 are elevational views of the clamp embodiment appearing in FIGS. 16 and 17 on a rail mounting structure, shown in the locked and unlocked position, respectively.
Figure 19:
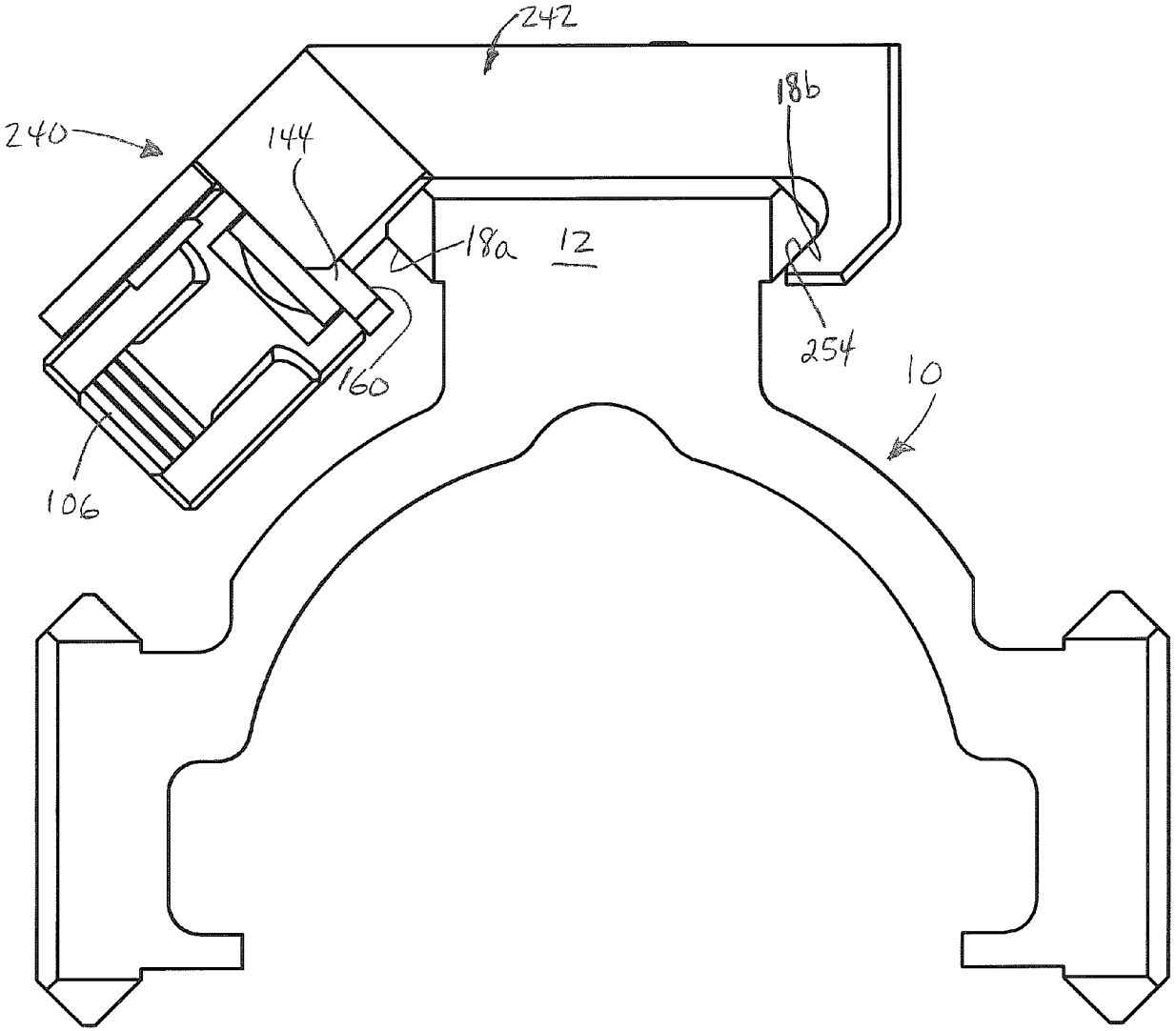
Figure 21:
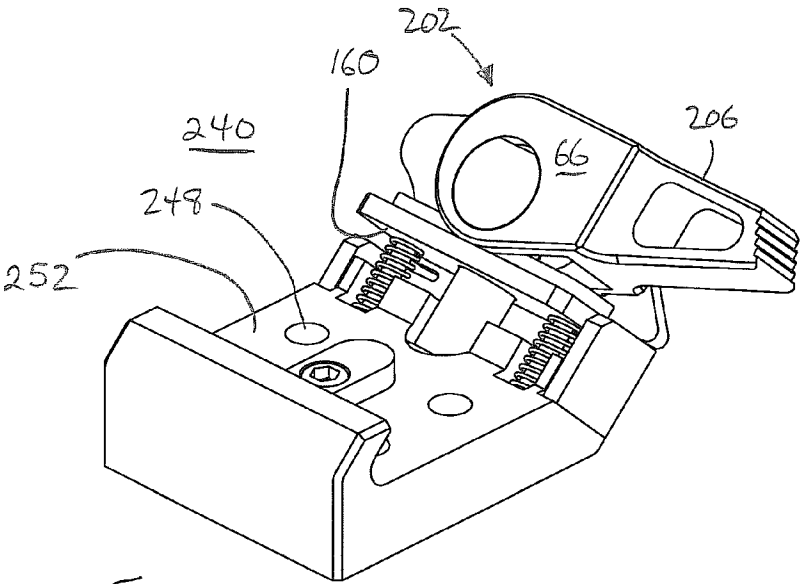
FIGS. 20 and 21 are isometric views of the clamp embodiment appearing in FIGS. 16-19, taken generally from the bottom and shown in the locked and unlocked position, respectively.
Figure 20:
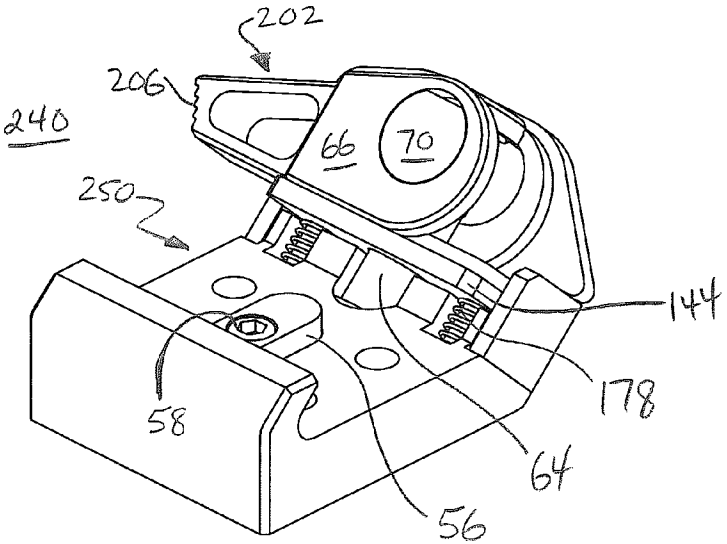
Figure 22:
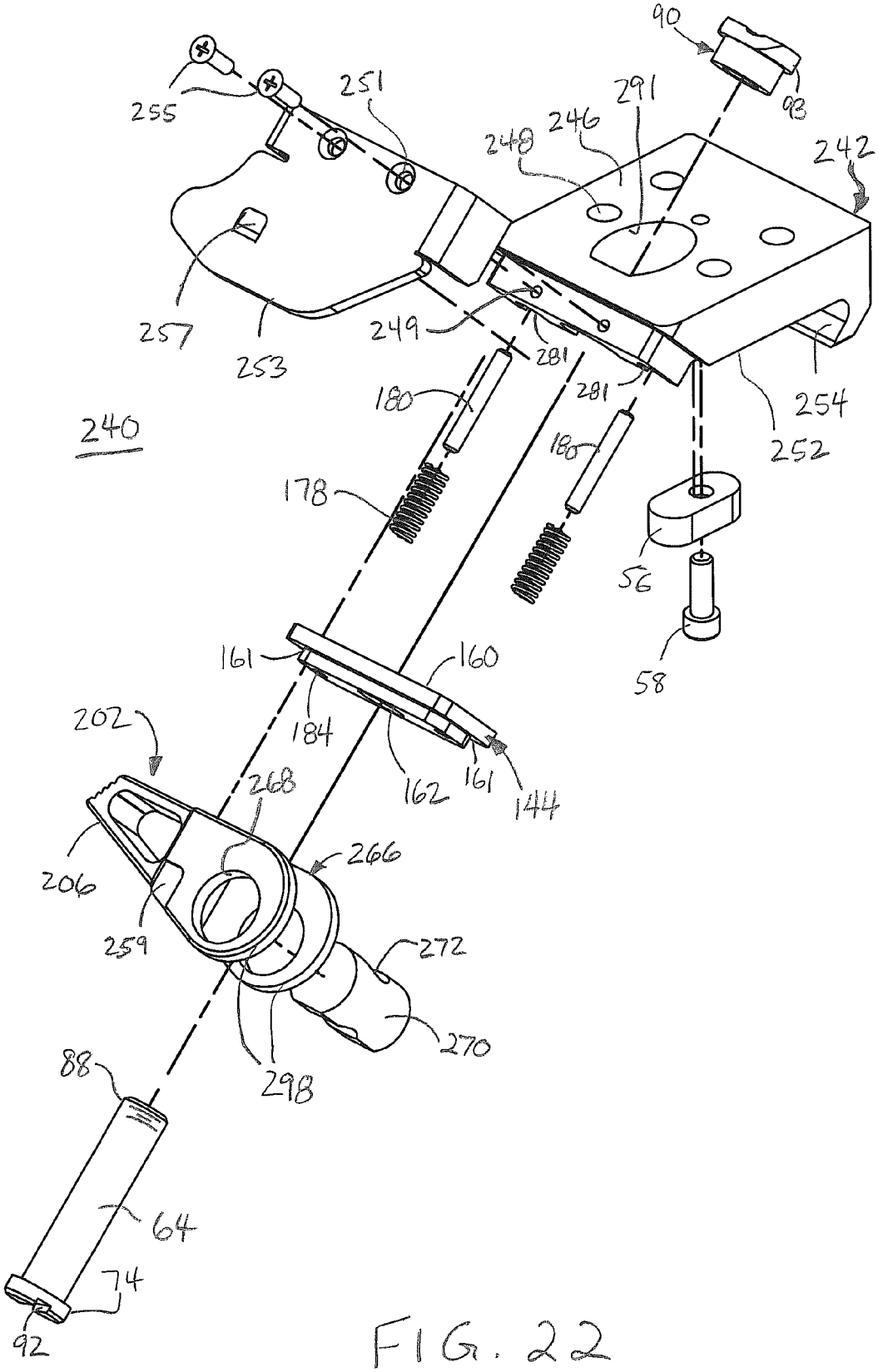
FIG. 22 is an exploded isometric view of the clamp embodiment appearing in FIGS. 16-21.
Figure 23:
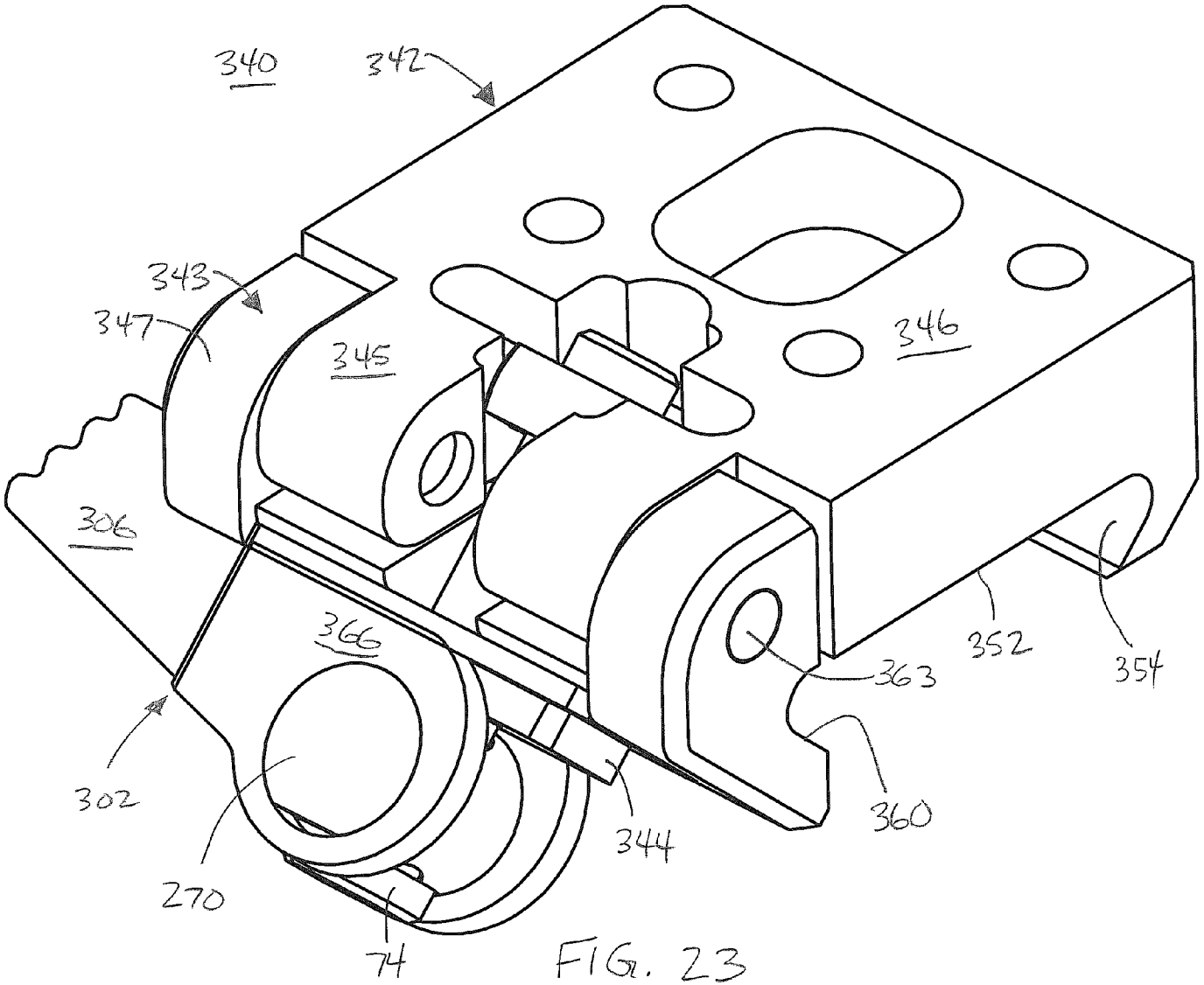
FIGS. 23 and 24 are isometric views of a fourth exemplary embodiment clamping device, in locked and unlocked position, respectively.
Figure 24:
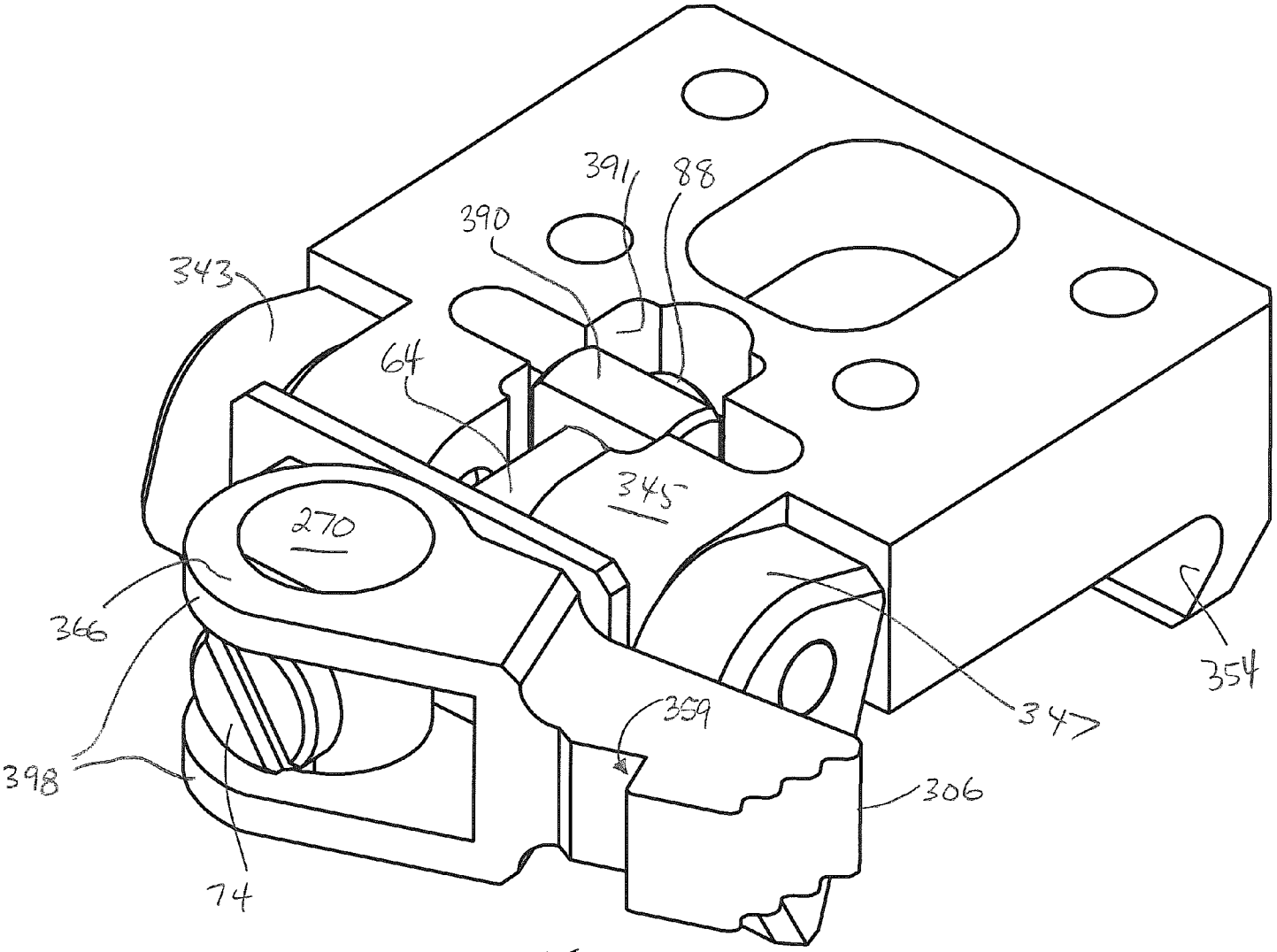
Figure 25:
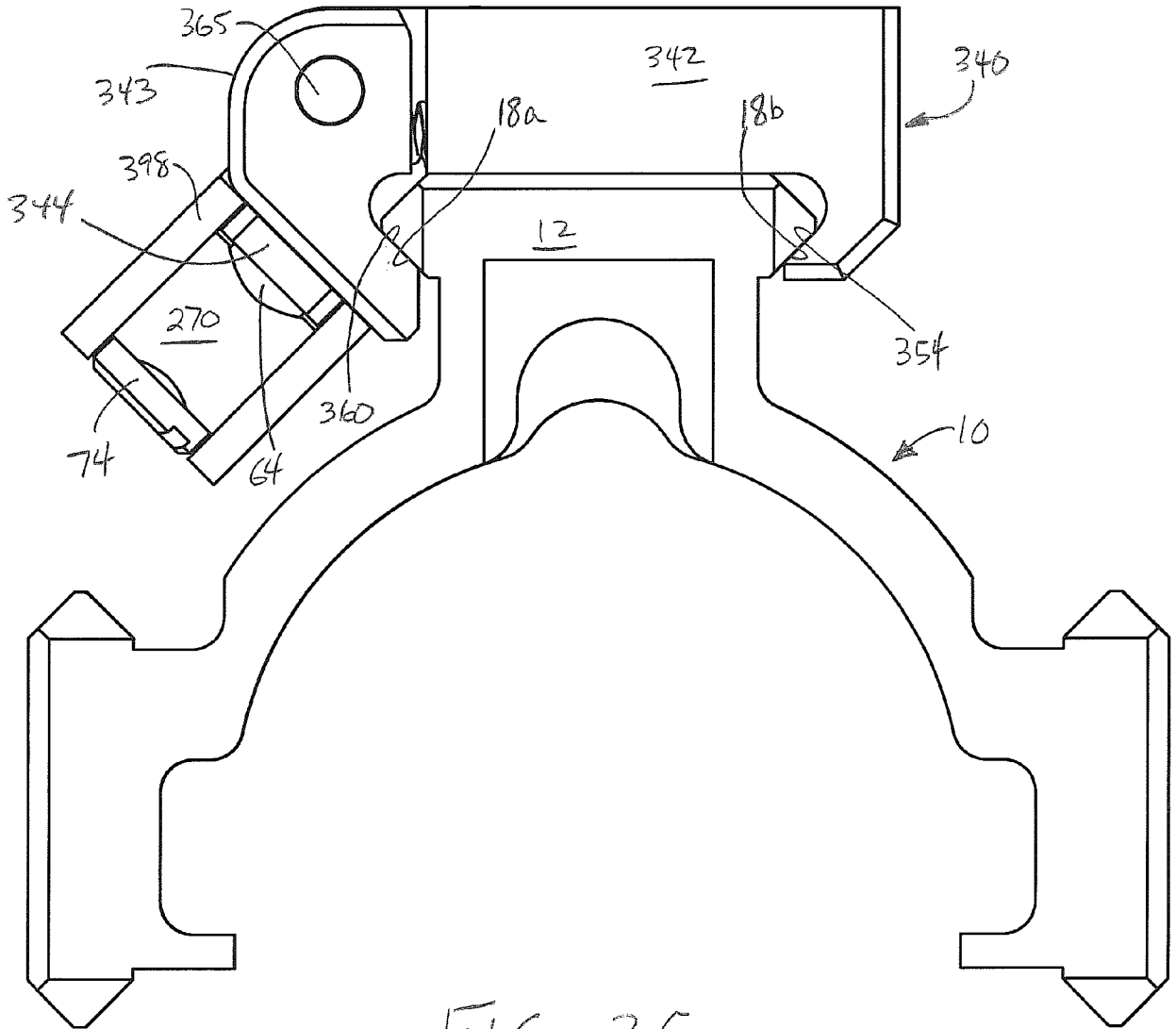
FIG. 25 is an elevational view of the clamp embodiment appearing in FIGS. 23 and 24, shown on a rail mounting structure, in the locked position.
Figure 26:
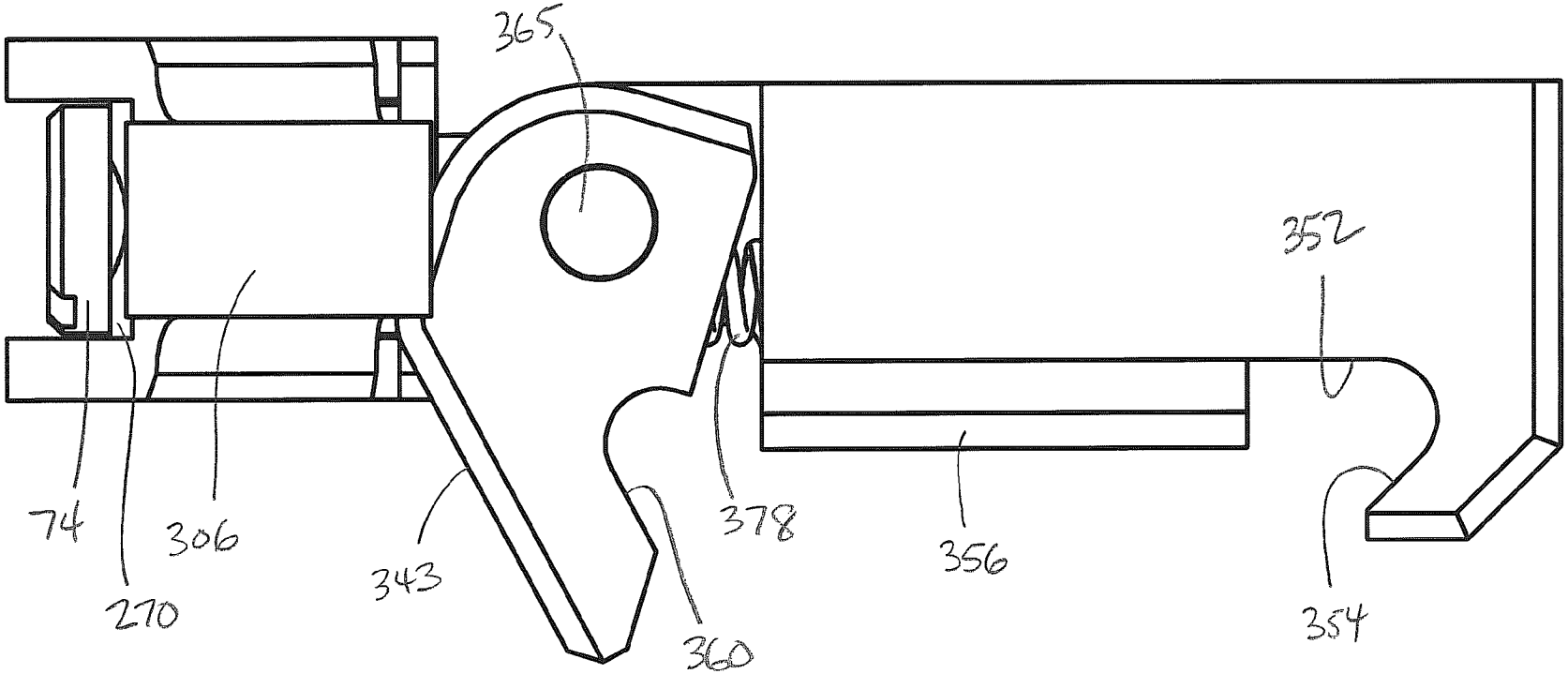
FIG. 26 is an elevational view of the clamp embodiment appearing in FIGS. 23-25 in the unlocked position.
Figure 27:
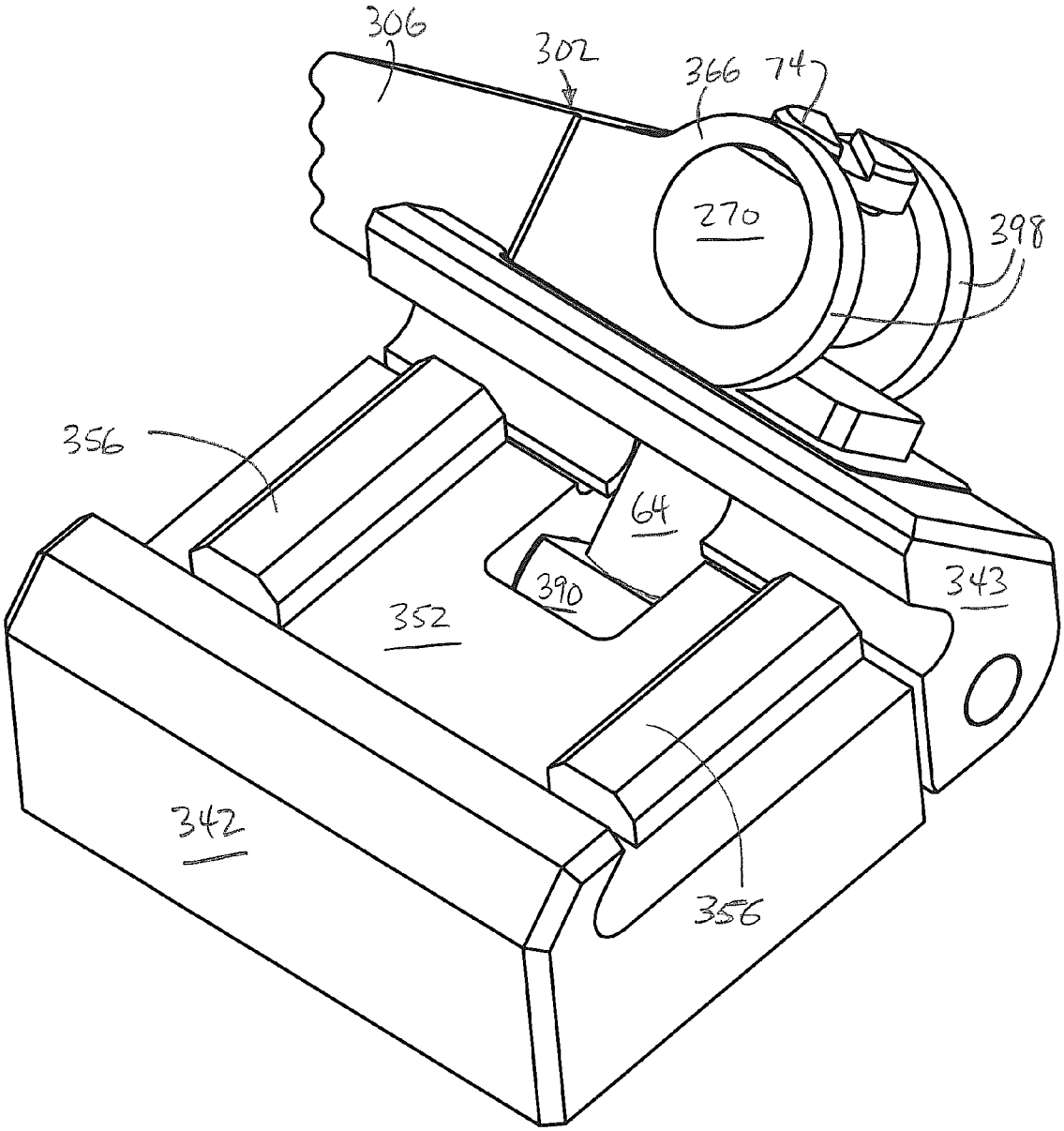
FIG. 27 is an isometric view of the clamp embodiment appearing in FIGS. 23-26 in locked position, taken generally from the bottom.
Figure 28:
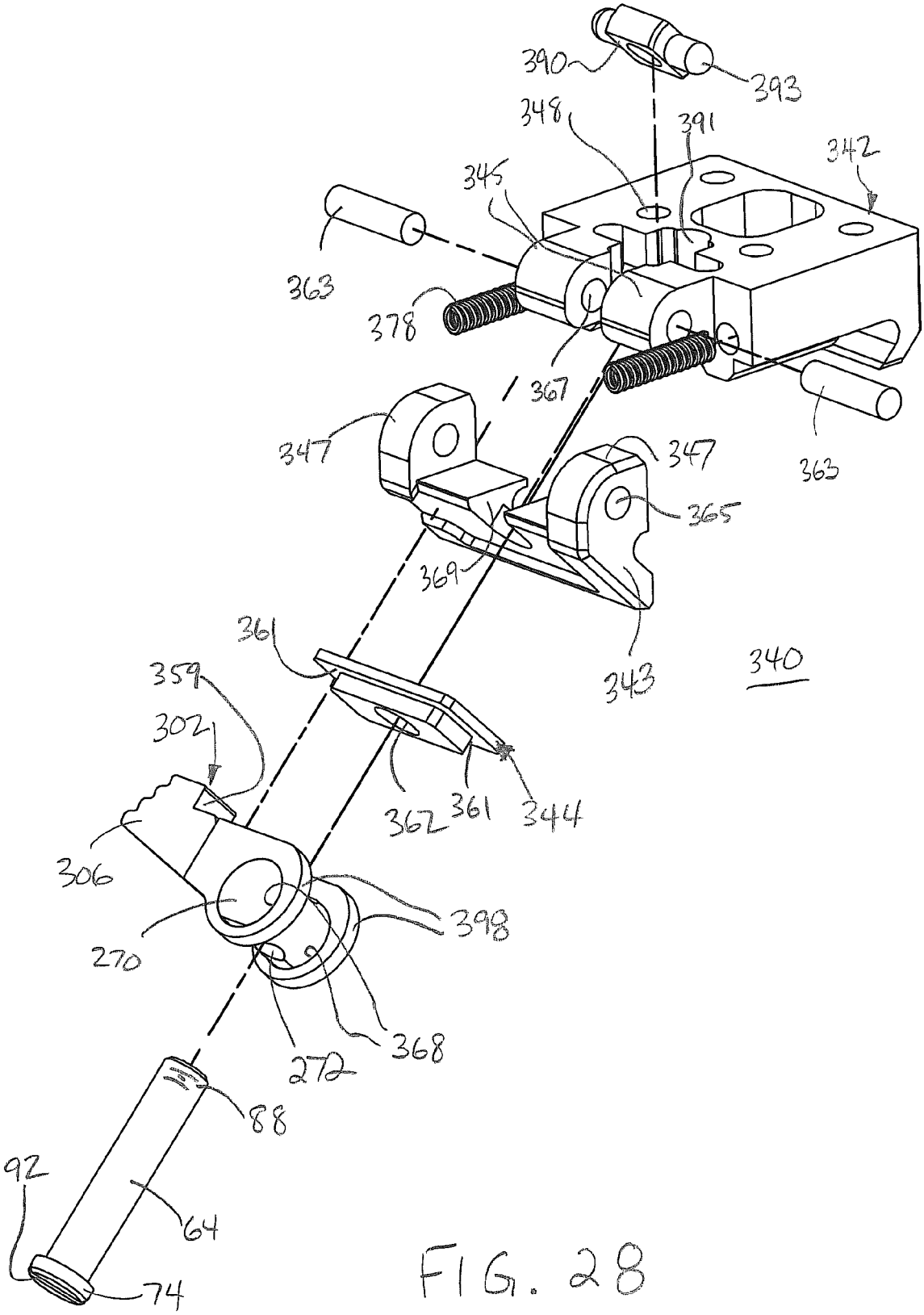
FIG. 28 is an exploded isometric view of the clamp embodiment appearing in FIGS. 23-27.

Referring now to FIGS. 14 and 15, there is shown a clamping device 140 according to a second exemplary embodiment, which is similar to the clamping device embodiment 40 appearing in FIGS. 4-13, except that coil springs are used in place of the spring fingers 78 (see FIG. 12) for biasing the bearing plate to the unclamped position when the cam lever is moved to the unlocked position. Components or features common to the first and second embodiments 40 and 140 are designated with like reference numerals in the drawing figures. Such like reference numerals appearing in FIGS. 14 and 15 are as described by way of reference to FIGS. 4-13 unless indicated otherwise.

The clamping device 140 includes a mounting shoe 142 and a movable clamping member 144. The mounting shoe 142 includes an upper (in the orientation shown in FIGS. 14 and 15) surface 146 and apertures 148, e.g., tapped or threaded openings for securing an accessory device (not shown) thereto.

The mounting shoe 142 defines an axial channel 150 defined by a first inner surface 152 opposite the upper surface 146 for engaging the mounting surface 14 of a rail structure 12. The axial channel 150 is also defined by a second inner surface 154 for engaging the adjacent distal inclined surface 18*b*. The movable clamping member 144 is movable into clamped position to engage the opposite distal inclined surface 18*a*.

A protruding member 56 may be secured to the inner surface 152 via a threaded fastener 58 for engaging an aligned one of the grooves 20 to prevent axial movement of the clamping member 140, e.g., due to firearm recoil.

The bearing plate 144 is movable between a first, unclamped position and a second, clamped position and includes a first, rail engaging surface 160, which engages the distal inclined surface 18*a* which is on the opposite side of the structure 12 as the rail surface 18*b*, which is engaged by the surface 154. The bearing plate 144 also includes cam engaging surfaces 161 opposite the rail engaging surface 160.

The bearing plate 144 includes an opening 162 receiving a drawbar 64 such that the bearing plate 144 is slidable therealong. The bearing plate 144 is captured between a rotatable cam member 66 and the mounting shoe 142. The cam member 66 is rotatable between a locked position and an unlocked position. The bearing plate 144 is thus selectively moved between the clamped position and unclamped position when the cam 66 is moved between the locked and unlocked position, respectively.

The cam member 66 includes an offset opening 68 receiving a pivot pin or cylinder 70 about which the rotation of the cam member pivots or rotates. The drawbar 64 passes through an opening 72 in the pivot pin 70 and is retained by an enlarged head portion 74. Spring rods or pins 180 are secured to the bearing plate 144 on opposite sides of the drawbar 64, e.g., via a press fit, snap fit, friction fit, or other rigid attachment, within corresponding openings 184 in the bearing plate 144. The distal ends of the pins 180 are slidingly received within openings 181 in the mounting shoe 142. Springs 178 are coaxially received about the pins 180 and are captured between the bearing plate 144 and the mounting shoe 142 to urge the bearing plate 144 toward the unclamped position.

The drawbar 64 includes a threaded end 88 which rotatably engages a threaded nut 90 received within an opening 191 in the mounting shoe 142. Rotation of the drawbar 64, e.g., via a tool-engaging slot 92 provides for fine adjustment of the device as described above.

The springs 178 urge the bearing plate 144 against peripheral cam surfaces 98 on the cam member 66, whereby the bearing plate may be selectively moved toward and away from the distal inclined surface 18*a* by rotating the cam member 66. The bearing surface 160 lies in a plane which is orthogonal to the axis 100 of the drawbar 64 and thus is parallel to the facing distal inclined surface 18*a*. Thus, the bearing plate 144 exerts a force which is normal to or orthogonal to the facing distal inclined surface 18*a* when the cam 66 is rotated to the locked or clamped position.

A cam lever 102 is provided for the rotation of the cam member 66 and may be a locking cam lever 102 is as described above by way of reference to the locking cam lever 102 shown and described above by way of reference to FIGS. 4-13.

Referring now to FIGS. 16-22, a third exemplary embodiment clamping device 240 is shown, which is similar to the embodiment 140 appearing in FIGS. 14 and 15, but without the locking lever assembly. Components or features described above by way of reference to the first and second embodiments 40 and 140 and common to the third embodiment 240 are designated with like reference numerals in the drawing figures. Such like reference numerals appearing in FIGS. 16-22 are as described above by way of reference to the first and/or second embodiments unless indicated otherwise.

The clamping apparatus 240 includes a mounting shoe 242, a movable bearing plate 144, and a cam lever 202. The mounting shoe 242 includes an upper (in the orientation shown in FIG. 16) surface 246 and apertures 248, e.g., tapped or threaded openings for securing an accessory device (not shown).

The mounting shoe 242 defines an axial channel 250 defined by a first inner surface 252 opposite the upper surface 246 for engaging the mounting surface 14 of a rail structure 12. The axial channel 250 is also defined by a second inner surface 254 for engaging the adjacent distal inclined surface 18*b*. The movable clamping member 144 is movable into clamped position to engage the distal inclined surface 18*a*.

A protruding member 56 may be secured to the inner surface 252 via a threaded fastener 58 for engaging an aligned one of the grooves 20 to prevent axial movement of the clamping member 240, e.g., due to firearm recoil.

The cam lever 202 includes a lever portion 206 and a cam portion 266. The cam portion 266 is pivotally mounted to a pivot cylinder or pin 270 received within an offset opening 268. The cam portion 266 includes cam surfaces 298, which bear against bearing surfaces 161 of the bearing plate 244.

A draw bar 64 including a shaft portion with threaded end 88 and an enlarged head portion 74 is received through an opening or channel 272 in the cylinder 270, an opening 162 in the bearing plate 144 and an opening 291 in the mounting shoe 242. An internally threaded nut 90 within the opening 191 rotatably receives the threaded end 88 of the draw bar 64. The nut 90 includes an enlarged or flange portion 93 to retain the nut 90 within the channel 291.

The drawbar 64 may be rotated relative to the nut 90, e.g., via tool engaging a slot 92, to adjust the unit as described above. A set screw 94 (see, FIG. 15) may be provided to prevent further inadvertent rotation of the drawbar 64 once it has been adjusted, as described above.

Rods or pins 180 are secured to the bearing plate 144, e.g., preferably via a press fit, snap fit, or friction fit within corresponding openings 184 on the bearing plate 144, or, may be otherwise rigidly attached to the bearing plate 144. The distal ends of the pins 180 are slidingly received within openings 281 in the mounting shoe 242. Each of the pins 180 carries a coil spring 178.

In operation, when the lever 202 is pivoted from the unlocked position to the locked position, the cam surfaces 298 bear against the surfaces 161 of the bearing plate 144 causing the bearing plate 144 to slide inwardly toward the mounting shoe 242, against the urging of the springs 178.

A lever guard 253 is secured to the mounting shoe 242 via one or more threaded fasteners 255 engaging openings 251 in the lever guard and openings 249 in the mounting shoe 242. The lever guard 253 covers the lever 202 to prevent snagging or inadvertent release of the lever 202. The lever guard 253 may also include a tab or protrusion 257, which is adapted to engage a complimentary and aligned recess 259 formed on the lever 202. The tab 257 and recess 259 may be configured to permit the lever 202 to be readily moved into the locked position while resisting movement of the lever 202 from the locked position to the unlocked position, e.g., via ramping or inclination of the sliding surfaces. For example, the tab 257 and the recess or depression 259 may be shaped such that a slight upward lifting of the lever guard 253 will release the tab 257 from the recess 259 and permit movement of the lever 202 from the locked position to the unlocked position.

During operation, the inclined surface 254 is in aligned and facing relation to the inclined surface **18*b* on one side of the rail mount member 12. The bearing plate 144 includes a bearing surface opposite the cam engaging surfaces 161, which, during operation, is in aligned and facing relation to the inclined surface 18*a* on the other side of the rail mount member 12. The direction of the bearing plate 144 movement and the direction of the force exerted by the cam 266 are a direction that is orthogonal to the adjacent inclined surface 18*a***.

Referring now to FIGS. 23-28, a fourth exemplary embodiment clamping device 340 is shown. Components or features described above by way of reference to the first, second, and/or third embodiments 40, 140, and 240 which are common to the fourth embodiment 340 are designated with like reference numerals in the drawing figures. Such like reference numerals appearing in FIGS. 23-28 are as described by way of reference to the above-described embodiments unless indicated otherwise.

The fourth embodiment clamping device 340 includes a mounting shoe member 342, a pivoting member 343, and a cam lever 302. The mounting shoe 342 includes hinge members 345 and the pivot member 343 includes hinge members 347. Pivot pins 363 extend through openings 365 and 367 in adjacent ones of the hinge members 347 and 345, respectively.

Apertures 348, which are preferably tapped or internally threaded apertures, are provided to secure an accessory (not shown) to be mounted on the weapon. Springs 378 are captured between the mounting shoe 342 and the pivoting member 343 to bias the pivot member 343 outward and to cause the pivot member 343 to pivot about the pivot pins 363 to the outward, open position when the lever 302 is moved to the unlocked position.

The lever 302 is pivotally mounted to a pivot cylinder or pin 270 and includes a cam portion 366 and a lever portion 306. The cam portion includes an offset opening 368 for pivotal receipt of the pivot cylinder 270 and cam surfaces 398 which bear against cam engaging surfaces 361 of a bearing plate 344, which is carried on the pivot member 343.

A draw bar 64 including an elongate shaft portion having a threaded end 88 and an enlarged head portion 72 is received through an opening 272 in the cylinder 270, an opening 362 in the bearing plate 344, an opening or channel 369 in the pivot member 343, and between the hinge members 345.

An internally threaded nut 390 rotatably receives the threaded end 88 of the draw bar 64. The nut 390 includes integral pins 393 and is pivotally received in a cavity 391 formed in the mounting shoe 342. The drawbar 64 may be rotated, e.g., using a tool engaging a slot 92 to fine tune the device 340 by selectively advancing or retracting the drawbar 64, e.g., to accommodate minor variations from one rail interface structure 10 to another as described above.

In operation, when the lever 302 is pivoted from the unlocked position to the locked position, the cam surfaces 398 bear against the cam engaging surfaces 361 of the bearing plate 344, which in turn causes the pivoting movement of the pivoting member 343. Movement of the lever 306 to the locked position causes the pivot member 343 to pivot inwardly about the pivot pins 363 against the urging of the springs 378. The lever portion 306 of the cam lever 302 may include a notch 359 formed therein receiving the pivot member 343 when the lever is in the locked or clamped position to prevent snagging or inadvertent release.

The mounting shoe 342 includes an axially extending channel 350 defined by an inclined surface 354 and an adjacent surface 352, which is opposite an upper mounting surface 346. In operation, the inclined surface 354 is in aligned and facing relation to the inclined surface **18*b* on one side of the rail mount member 14 and the surface 352 is aligned and facing the upper mounting surface 14 of the rail structure 12. One or more protrusions 356 sized to engage one or more of the grooves or channels 20 may be provided on the surface 352** to prevent axial movement of the clamping apparatus, e.g., due to recoil when the weapon is fired.

The pivot member 343 includes an inclined bearing surface 360 which is in aligned, facing, and contacting relation to the inclined surface **18*a* on the opposite side of the rail mount member 12 when the clamp is secured to the rail structure 12. Because the pivot member 343, cam lever 202, and drawbar 64 all pivot during clamping, the force exerted by the bearing surface 360 on the rail mount surface 18*a* is orthogonal to the plane of the surface 18*a***.

In the illustrated embodiments, the fixed inclined surface of the mounting shoe is shown engaging the distal inclined surface **18*b* of the rail structure 12 and the moveable clamping member is shown engaging the distal inclined surface 18*a***. However, it will be recognized that the clamping member may be reversed if desired, e.g., to accommodate left and right handed marksmen or otherwise depending on which side of the rail the user desires to position the locking and unlocking lever.

The invention has been described with reference to the preferred embodiments. Modifications and alterations will occur to others upon a reading and understanding of the preceding disclosure herein, whereby it is to be distinctly understood that the foregoing descriptive matter is to be interpreted merely as illustrative of the invention and not as a limitation.

Having thus described the preferred embodiments, the invention is now claimed to be:

1. An improved clamping device for a weapon accessory rail of a type having an elongate mounting structure of generally T-shaped cross-sectional shape, the mounting structure including a mounting surface, first and second proximal surfaces on opposite sides of the mounting surface and inclined with respect to the mounting surface, a first distal surface adjacent to and inclined with respect to the first proximal surface, and a second distal surface adjacent to and inclined with respect to the second proximal surface, said clamping device comprising:

a mounting shoe including a first inward facing surface for engaging the mounting surface of the mounting structure and an outward facing surface opposite the first inward facing surface for attaching an accessory device thereto;

said mounting shoe further including a second inward facing surface for engaging the second distal surface of the mounting structure;

a cam lever pivotally movable between a first position and a second position, said cam lever having a rotary cam surface engaging a bearing member; and said bearing member movable to a clamped position in response to movement of said cam lever to said first position and an unclamped position in response to movement of the cam lever to the second position, said bearing member for exerting a net clamping force on the first distal surface of the mounting structure when said bearing member is in the clamped position, wherein the net clamping force exerted by said bearing member is in a direction orthogonal to the first distal surface.

2. The clamping device of claim 1, further comprising:

said bearing member including a bearing plate having a first surface engaging said rotary cam surface and a second surface opposite said first surface for engaging the first distal surface.

3. The clamping device of claim 1, further comprising:

said bearing member including a pivot arm pivotally attached to said mounting shoe and pivotally movable in response to pivoting movement of said cam lever.

4. The clamping device of claim 3, further comprising:

a bearing plate carried on said pivot arm; and said rotary cam surface engaging said bearing plate.

5. The clamping device of claim 1, further comprising:

one or more springs urging the bearing member to the unclamped position when the cam lever is moved to the second position.

6. The clamping device of claim 5, wherein said one or more springs are selected from one or more coil springs and one or more leaf springs.

7. The clamping device of claim 1, further comprising:

said cam lever pivotally mounted on a pivot pin having an axis extending in a direction parallel to the first distal surface.

8. The clamping device of claim 7, further comprising:

a shaft extending through an opening in said pivot pin and having a first end attached to said mounting shoe.

9. The clamping device of claim 8, further comprising:

said shaft extending in a direction orthogonal to the first distal surface when the clamping device is attached to the mounting structure.

10. The clamping device of claim 8, further comprising:

said shaft extending in a direction orthogonal to the first distal surface when the clamping device is attached to the mounting structure and said cam lever is in the first position.

11. The clamping device of claim 8, further comprising:

said first end of said shaft having external helical threads which engage complimentary internal threads on said mounting shoe for selectively advancing the shaft along its axis when the shaft is rotated in a first direction and retracting the shaft along its axis when the shaft is rotated in a second direction opposite the first direction.

12. The clamping device of claim 11, further comprising:

said complimentary internal helical threads being formed in a nut received within an opening formed in said mounting shoe.

13. The clamping device of claim 1, further comprising:

said mounting structure having a plurality of axially spaced apart transverse channels formed therein; and a protrusion formed on said first inward facing surface for engaging a selected one of said transverse channels.

14. The clamping device of claim 1, further comprising:

means for locking said cam lever in the first position.

15. The clamping device of claim 1, further comprising:

said cam lever pivotally mounted on a pivot cylinder and including a proximal shaft portion and a distal shaft portion slidably received within said proximal shaft portion;

said distal shaft portion telescopically movable between a lever locking position and a lever unlocking position; and said distal shaft portion having a protrusion engaging a complimentary recess formed in said pivot cylinder to prevent pivoting movement of said cam lever with respect to said pivot cylinder when the cam lever is moved to the first position and the distal shaft portion is moved into the lever locking position.

16. The clamping device of claim 1, wherein said outward facing surface is adapted for removably attaching the accessory device.

* * * * *